United States Patent [19]

Cockerell

[11] 3,974,334

[45] Aug. 10, 1976

[54] WAVEFORM PROCESSING

[75] Inventor: David Cockerell, London, England

[73] Assignee: Electronic Music Studios (London) Limited, London, England

[22] Filed: Dec. 21, 1973

[21] Appl. No.: 427,266

[30] Foreign Application Priority Data

Dec. 22, 1972 United Kingdom ..... 59540/72

[52] U.S. Cl. ..... 179/1 SA

[51] Int. Cl.[2] ..... G10L 1/00

[58] Field of Search ..... 179/1 SA, 1 SM

[56] References Cited

UNITED STATES PATENTS

| | | | |
|---|---|---|---|
| 3,183,303 | 5/1965 | Clapper | 179/1 SM |
| 3,697,699 | 10/1972 | Gluth et al. | 179/1 SA |
| 3,703,609 | 11/1972 | Gluth | 179/1 SA |

*Primary Examiner*—Kathleen H. Claffy
*Assistant Examiner*—E. Matt Kemeny
*Attorney, Agent, or Firm*—Haseltine, Lake & Waters

[57] ABSTRACT

A complex waveform synthesizer comprises a plurality of digital oscillators producing unit waveforms at distinct frequencies and constituted by respective storage zones storing, as digital words, the momentary values of the waveforms. The required amplitudes of the waveforms are produced by a digital modulator supplied with trains of digital desired amplitude values from a digital interpolator receiving corresponding trains of desired digital values at a slower rate than those supplied by the interpolator. The modulator supplies the waveforms, with an amplitude definition greater than that of the desired values supplied to the interpolator, to a digital accumulator which combines the digital words it receives to produce a series of digital words defining a complex waveform which is the sum of the individual waveforms defined by the series of words emerging from the modulator.

13 Claims, 36 Drawing Figures

DIGITAL TO ANALOG CONVERTER
13
9
ACCUMULATOR
f2
DRIVER
31
A
G
H
10
FUNCTION GENERATOR
Y
11
X
MODULATOR
12 BIT STORAGE LOCATIONS
25
(12)
MEMORY
30
A
U
V
(3)
(20)
N
M
M=N+3F
F
27
ADDER
(8)
(12)
ADDRESS
26
28
G
H
A
MEMORY
f1
29
(10)
DRIVER

TWG 64D5
XX21
XX27
XX1X
XX5X
PNY
CUT
LCAT
64D3
64E7
BM2
BM1
BM3
BM5
BM0
VDP
LDA 64B1
LKF 64B3
LKA 64B5
FROM UTP
XXX1
XXX3
XXX5
XXX7
E15
A
B
C
LBMB11
LBMB10
LBMB9
IFR7
IFR6
IFR5
IFR1
IFR3
IFR2
IFR4
IFR0
IFC
E23
E24
E19
E20
Q
P
PR
CK
CL
DV
QA
QB
QC
QD
DA
DB
DC
DD
CK2
X
ENV
BLOB
AAP
LBMB7
LBMB6
LBMB8
FROM PNY
FROM X
BM5
BACO

WAVEFORM FUNCTION GENERATOR
10
A0-9
G0-8
H0-7
H8
C3
CE
W
FROM J0-9 (FIG. 11)
FROM L0-7 (FIG. 11.)
FROM H0 (FIG. 11.)
GUV0 (MF)
FROM B0-5 (FIG. 11)
MULTIPLIER
11
Y0-8
X8
X0-7
A0-17
0V
FROM X0-7 (FIG. 12)
GUV0 (NF)
ACCUMULATOR
9
C0
C1
C0
C2
C4
P0
F7-16
A0-17
D-A-C CONVERTER
13
SH
A0-5
A6
A7
A8
A9
A10
F0-15
FOP
UFOP
0V
GUV8
A0-5 (BAC6-11)
A(A(BAC3))
A(BAC3)
LOA
BAC0,1,2

7
6
5
4
3
2
1
0
1FR
GUV2
GUV20
GUV21
GUV26
G
E
GUV 15WA
GUV 15WB
GUV 15WC
GUV 15F1
GUV 15F2
GUV9A
GUV9B
GUV9C
GUV 12A
GUV 12B
GUV 12C
GUV 11A
GUV 11B
GUV 11C
GUV 13
F
C
2
M-1
M-2
CK
D
Q
9
8
7
6
LAL
0V

WAVEFORM PROCESSING

BACKGROUND OF THE INVENTION

This invention relates to waveform processing, transmission and synthesis and is applicable to speech and music analysis and synthesis and vocoders.

SUMMARY OF THE INVENTION

According to one aspect of the invention, there is provided a waveform analysis and synthesis system comprising an analyser operable to produce from a complex waveform a plurality of digital signals representing the component of the complex waveform in respective frequency bands, and the system also comprising a synthesiser comprising a corresponding plurality of digital waveform producing means each operable to produce from the digital information relating to an associated frequency band digital information defining successive points of a corresponding waveform at a specific frequency. The plurality of waveform producing means preferably comprise common means operable on a time-multiplexing basis to feed the information defining the points of the waveforms into a corresponding plurality of store zones.

When a direct transcription of music or speech is required, the frequency of the waveform producing means in each case will be within the associated frequency band of the analyser, but in some embodiments provision will be made for adjusting the frequency of at least some of the waveform producing means so that some modification of the sound may be achieved (e.g. under computer control) such as for transposition of music.

In one application of this system, the system is a vocoder system wherein the analyser is at a transmitting station and the synthesiser is at a receiving station.

According to another aspect of the invention there is provided a waveform synthesiser having a plurality of waveform producing means each operable to produce a digital signal representing a waveform at a distinct frequency, and storage means of signals for defining the operation of said waveform producing means, these signals having been obtained by measuring the energy content of a complex waveform in respective frequency bands.

It will be apparent that the above aspects of the invention are based on the concept of analysing a complex waveform in terms of frequency bands and reproducing this energy content not in corresponding frequency bands but rather at discrete frequencies, the generation of these discrete frequencies being effected digitally. It has been found that this system can be implemented to reproduce the human voice with sufficient accuracy as to render the voice recognisable. This has even been the case when the analyser or storage means produces for each waveform one digital signal (defining one point of the waveform) once every 1400 $\mu$ seconds or at an even slower rate and when the synthesiser includes an interpolator interpolating a multiplicity of points between the points defined at its input, the interpolator producing digitally defined points at, say, 46,000 per second.

According to another aspect of the invention there is provided a waveform synthesiser comprising digital waveform producing means including a plurality of storage zones and operable to produce in the zones respective series of digitally coded words representing in each series values of successive points of a waveform at a specific frequency within the audible range, the frequencies of the waveforms being distributed or distributable substantially throughout the audible range, means operable to combine the series from the zones to produce a series of words representing values of successive points of a composite waveform, and control means for controlling a parameter of the waveforms represented by at least some of said series of words.

In a basic case, the parameter is amplitude, but may also or alternatively be frequency and/or wave shape and/or phase.

Preferably, the control means has an input for receiving a series of digitally coded words at a rate less than that of the series the control means supplies, the control means having an interpolator for interpolating the series it supplies from the series it receives.

Embodiments of the last aspect of the invention may be regarded as special purpose digital computers operable to receive data at said control means at a comparatively slow rate from a general purpose data processor and to transform that data into digitally coded waveforms each being synthesised point-by-point at a faster rate of, say, 46,000 points per second. Various modes of transformation are possible, and as one example, there is the inverse Fourier transform and certain variants of it particularly applicable to the generation of musical sounds. Such embodiments use digital circuits to compute the instantaneous value of time varying functions in real time. The speed of currently available integrated logic circuits allows the same hardware to be time-shared among several waveforms, each waveform being adjustable throughout the audible spectrum.

In one application of the invention, a computer may store on disc and/or on tape a large number of words each in the form of digitally coded words, so that the computer may then be operable to select certain ones of these words to create a message fed to the synthesiser where the desired message can be created in a suitable form for transmission, say, on a telephone line. Thus, not only can one store spoken messages of any length but it is also possible to assemble sentences of acceptable grammatical structure from the stored bank of individual words. The necessary computer to service the synthesiser can also perform other calculations and instruct the synthesiser to speak the result. For example, an inventory control system using the synthesiser might receive input data from a store keeper as he despatched items and would calculate what remained, continuously updating the store. A salesman would then need only to 'phone to the synthesiser terminal to check the latest stock situation and he will actually receive the required message in spoken form. Thus, in general terms, one might have a mass of information instantly available to a number of telephone subscribers, this information being deliverable in normal everyday language.

By analysing, or by representing, a complex waveform in terms of its content in discrete frequency bands and by then reproducing the waveform by synthesising each frequency band by a discrete frequency, it is possible to select essential and reject unnecessary voice data and to store the highly complex patterns of speech and other waveforms in a more economical way than heretofore. It also follows that information content produced in this digital form can be transmitted in bulk over communication channels in a relatively short time, using the least busy hours on the world's telephone and telex lines.

For a better understanding of the invention and to show how the same may be carried into effect, reference will now be made, by way of example, to the accompanying drawings, in which.

Figure 1:
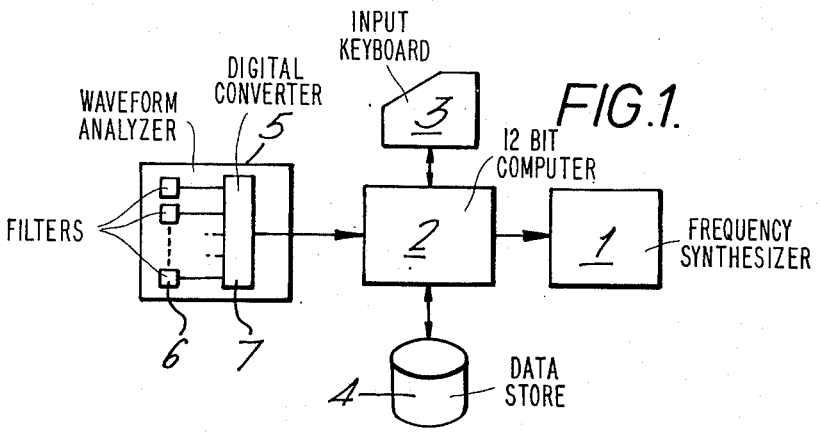
FIG. 1 is a diagrammatic representation of a computerised waveform analysis and synthesis system.

FIG. 1 shows in block diagram form a waveform analysis and synthesis system including a frequency domain synthesiser 1 which is a special purpose computer performing the function of a bank of 64 oscillators each programmable in amplitude, waveform and frequency. With these possibilities, the synthesiser itself has various applications, e.g. in research such as vibration analysis. In the form to be described and also in a simplified form, the synthesiser is also suitable for speech synthesis, say in a communication system, when waveform and frequency may be fixed so that only amplitude need be varied in use. As illustrated, the synthesiser 1 is designed to be supplied with information from a 12-bit general purpose computer 2 such as that marketed as PDP8 by Digital Equipment Corporation. Also illustrated is an input keyboard 3 for the computer 2 and also a data store 4 such as a disc. An additional data input to the computer 2 is provided by a waveform analyser 5. As diagrammatically represented by FIG. 1, the analyser has 64 filters 6 each tuned to a distinct frequency band to analyse the waveform content in the associated frequency band. This information is digitised by an analogue to digital converter 7 which produces for each of the filters 6 a series of digitally coded words representing the amplitude content in the frequency band concerned. This information is fed to the computer 2 and stored in its store 4. Each series of digitally coded words may also have associated with it digitally coded words defining the relevant frequency band, as such a band may be adjustable, and also digitally coded words defining the "address" of the relevent filter 6 so that this information may be supplied to the appropriate one of the digitally represented 64 oscillators in the synthesiser 1.

In the case of amplitude, frequency and waveform programming, the synthesiser 1 is initally programmed with amplitude, frequency and waveform characteristics from the store 4. For subsequent synthesis of waveforms, the computer 2 then provides for each of at least some of the 64 oscillators a series of digitally coded words each representing the required amplitude of the associated waveform at a particular point in time. These series are supplied as a single series, with the individual words of the various series being interleaved in time. To distinguish between the series each of the digitally coded words defining amplitude may be preceded, or followed, by a further digitally coded word defining the address of the associated oscillator. The pairs of these words could be supplied at anything up to a rate of one pair every 20 microseconds but a much slower rate is quite acceptable in practice. One of the functions of the synthesiser 1 is to interpolate additional values between those arriving from the computer 2 to minimise band width requirements.

Figure 2:
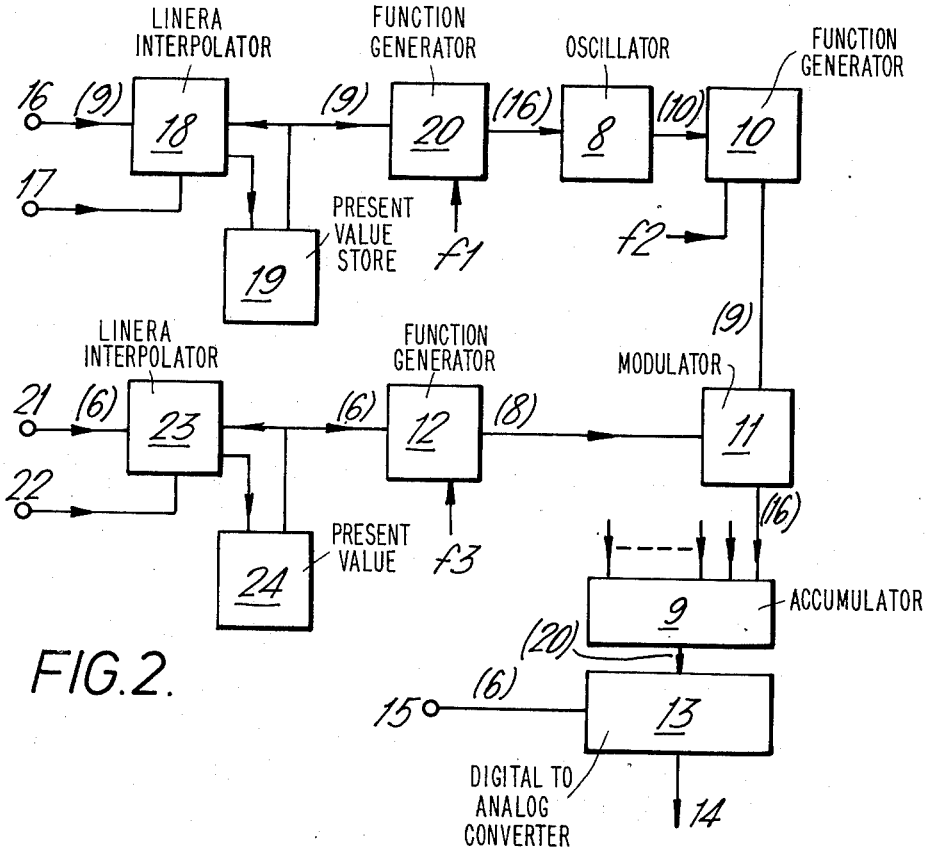
FIG. 2 is a block diagram illustrating certain features of a waveform synthesiser.

FIG. 2 is a block diagram representing the synthesiser 1. In this figure numbers are represented in brackets and these designate the number of digital bits which are transferred on the adjacent lines.

A significant item in the synthesiser is an oscillator 8 of which there are in fact 64 the outputs of which are finally summed in an accumulator 9, as is represented by the plurality of inputs to the accumulator 9. The oscillator 8 produces a saw-tooth waveform in the form of digitally coded words and this waveform is given the desired shape, for example that of a sine wave, in a function generator 10 which has previously been programmed by way of input $f_2$ with the desired waveform. The output of the function generator 10 is supplied to a modulator 11 which is under the control of a signal from a further function generator 12 (pre-programmed at input $f_3$ ). This further signal represents the desired amplitude of the waveform (emitted from generator 10 with unit amplitude). The waveform with its required shape, frequency and amplitude, is emitted by the modulator 11 and is summed in accumulator 9 with all the other similarly produced waveforms from the oscillator outputs.

As already mentioned, there are in effect 64 oscillators in the sense that the synthesiser is capable of producing sixty-four distinct waveforms each separately controllable as to frequency and amplitude. The combined complex waveform produced in digital form by the adding device 9 is fed to an exponential modulator and digital-to-analogue converter 13 so that a corresponding analogue output is produced, in real time, at output 14. Input 15 enables a signal to be applied to control the overall amplitude of the complex waveform.

It has been mentioned above that the oscillator is controllable as to frequency and this control is effected by way of inputs 16 and 17 which feed a linear interpolator 18 associated with a present-value store 19 and a further function generator 20 pre-programmed by way of input $f_1$. In a simple case, all the oscillators are operating at respective, fixed, frequencies and these may be fed in initially via input 16 and stored in store 19 for continuous use at the oscillators 8. It is possible, however, to vary the frequency of any one of the oscillators 8 during operation by feeding in a digital word at inputs 16 and 17 defining the new frequency required (at 16) and the time to be taken in traversing from the present value or frequency to this new value or frequency (at 17). The interpolator then interpolates a plurality of frequency values between the present value and the desired value and supplies these values one-by-one to the function generator wherein these values are converted according to a predetermined function before being supplied to control the frequencies of the oscillators. The linear interpolator 18 is capable of working to supply, during the time interval defined at input 17, up to about 46,000 points per second, thereby interpolating a large number of values between the present value represented in store 19 and the new desired value represented at input 16. Thus, a relatively slow data rate may be provided at 16, with a relatively high data rate being produced by the linear interpolator.

In this manner, each oscillator frequency can be defined to an accuracy of 0.25 Hz over the range 0–16KHz.

In a similar way the amplitude of each waveform produced by the oscillators may be controlled by amplitude values supplied at input 21 and time intervals supplied at input 22, both to a further linear interpolator 23 operating in the same manner as interpolator 18, being associated with a present value store 24 and the function generator 12. Thus, again, the linear interpolator 23 interpolates many values of amplitude in the time interval defined by input 22. This time interval is referred to herein as the slew time, being the time over which the interpolators will slew from an initial value to a desired value. The amplitude of each oscillator may be defined to an accuracy of 1 part in 256.

In practice, the elements shown may be shared on a time-sharing basis by all the oscillators. Moreover, it is possible to provide in the system separate groups, e.g. three, of the items 10, 11, 12, 23, 24, 9 and 13 to enable each waveform to be produced in three separate ways (i.e. as separate "voices") with separate amplitude control and with separate waveform characteristics. Thus, three separate analogue voices would be available with the waveforms of all oscillators contributing to one of those voices being of the same shape and being generated once by the computer 2 and being stored in the synthesiser at 10. The individual waveforms are defined to 9 bit precision at 1024 points in a cycle. Three separate waveforms can be stored, one for each voice, by virtue of the triplication of the generator 10. There are no significant restrictions on wave shape, except that of ensuring that the synthesiser is not instructed to generate components above the audio range. The voices are each under the master level control of digitally controlled amplifiers and all frequencies are derived from a single crystal reference oscillator and all amplitudes from one voltage source.

The method of frequency generation used is such as to preserve the phase continuity of an oscillator when its frequency is changed. Moreover, changes can be effected instantly.

To sum up so far, the synthesiser has, in effect, 64 oscillators each capable of simultaneously producing three periodic waveforms at any amplitude within a certain range. Such a system is theoretically capable of producing any sound provided that data can be efficiently organised to control it.

Although frequencies are generated inside the synthesiser to an accuracy of 0.25 Hz over the audio range, the transfer of 16 bits across the interface would clearly be a waste, since no listener could distinguish 64,000 separate frequencies, and this means that instead of 16 bits, only 9 bits are required to choose one of the predetermined steps. For the generation of diatonic music, a total of 120 suitably defined frequencies would suffice, but for broader applications it is considered that 512 would be an appropriate figure. This allows some 50 steps per octave if they are chosen to be on a logarithmic scale. Experiment has shown that a glissando composed of such steps sounds the same as a perfectly smooth slide. Each of the 512 points can denote any one of the 64,000 frequencies available; they need not be arranged on an equal tempered scale, nor need the relationship be monotonic. The points need be defined only once after turning on the power.

The same principle is used for wave shape and also for amplitude selections. In the former 1024 points, each of 9 bits, define waveform and 2 bits choose to which waveform an oscillator is directed. In the latter case 64 different amplitudes are available in the fast operational mode out of a maximum of 256. Note that if the 64 preselected amplitudes are arranged on a logarithmic scale, say 1dB per step, a point will be reached as one reduces amplitude when the resolution of the synthesiser is coarser than 1dB. This is considered acceptable as the attenuation would exceed 49dB at that point. A similar limitation applies to frequency selection below about 16 Hz.

Figure 3:
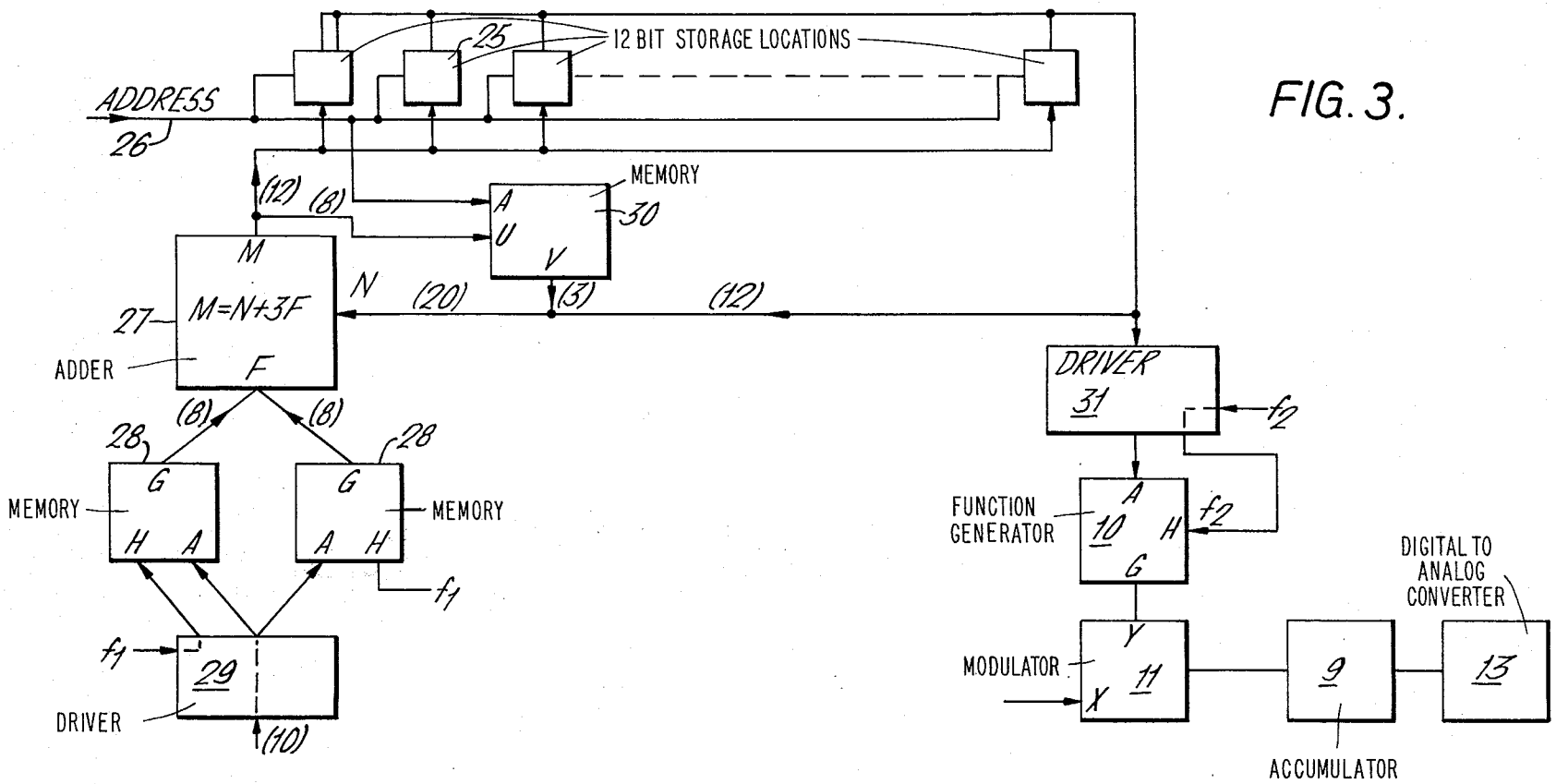
FIG. 3 is a more detailed block diagram illustrating features of a portion of the diagram of FIG. 2.

FIG. 3 is a diagram showing in more detail how the waveforms are produced.

FIG. 3 shows 64 12 bit storage locations 25 in which are stored the momentary values of the respective saw-tooth waveforms of the oscillators 8. These stores 25 can be addressed one-by-one by means of an address bus 26. The values fed into these stores are obtained from an adder 27 which delivers to an addressed store a value M which is equal to $N + 3F$, where N and F are two sets of incoming data to the adder 27. Data N is obtained from the outputs of the stores and thus represents the last calculated value of the saw-tooth waveforms. The values F are obtained from two memories, although a single memory could be used if need be. Two identical memory elements are used in the present case as this is an element which is used in identical form elsewhere in the synthesiser. In the memories 28 are stored the frequency function, such that the two memories 28 constitute the generator 20 of FIG. 2. These memories 28 are addressed by a driver 29 which receives its information from the present value store 19. It will therefore be seen that the value F represents the instantaneous frequency value for a particular oscillator and that the value M is therefore proportional to this frequency value. If, as will normally be the case, F is constant for a particular oscillator, it will be seen that N increments uniformly until a predetermined value (the maximum count of each store 25) is reached. When this value is reached for a particular store 25, that store resets to zero and counting-up continues as before. If the frequency information from the store 19 varies, then it will be appreciated that the gradient of the saw-tooth waveform will change accordingly.

In practice, the adder 27 delivers to the stores only the 12 most significant bits of its calculated value of M as indicated by the bracketed numerals. M is in fact calculated to 20 digits and the 8 least significant digits are stored in additional memory 30. The output of the memory 30 is returned to the adder 27 to form part of the value N for the adder. The outputs of the stores 25 are also fed to a driver 31 which delivers its contents to the function generator 10 which is a further memory identical to the memories 28. The output G of the function generator 10 is then fed to the modulator 11, which is a multiplier for multiplying its input Y with its input X, the latter input being derived from the amplitude function table 12. The output of the multiplier 11 is supplied to an accumulator which is the device 9 and which accumulates and sums the discrete waveform values from the respective oscillators and when all have arrived emits the sum to the digital-to-analogue converter 13.

Figure 4:
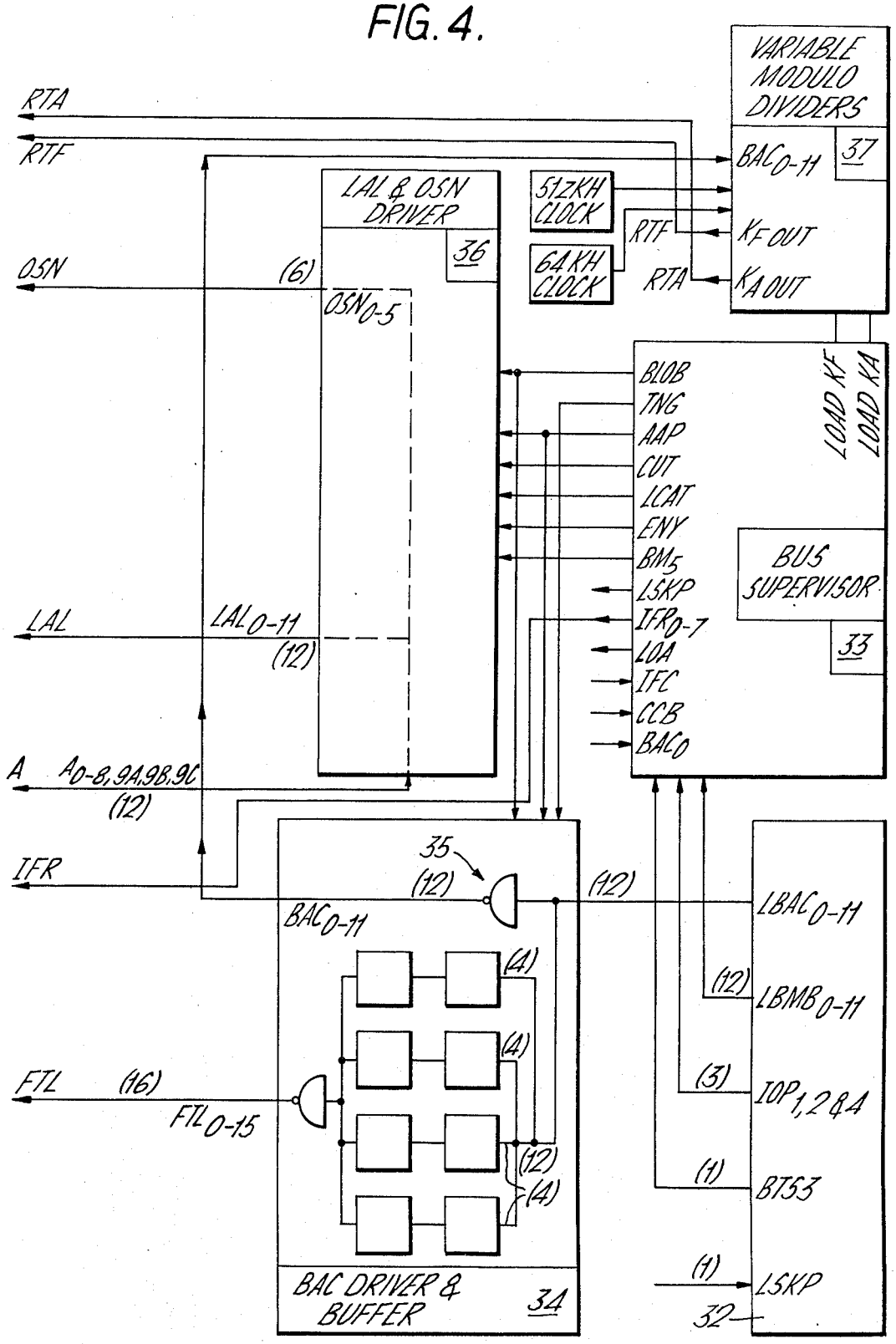
FIG. 4 is a diagram showing various printed circuit boards of a computer interface for the waveform synthesiser.

FIG. 4 is a diagram showing various printed circuit boards of a computer interface for the waveform synthesiser, giving in brackets the number of parallel signal channels represented by the associated lines in the figure. At 32 the computer (PDP-8) 2 is connected providing a 12 bit data input LBAC from the AC register of the computer, a 12 bit instruction input LEMB and other control signal inputs. At 32 a signal LSKP is fed to the computer to cause a new value from the AC register to be fed to the synthesiser. In the absence of LSKP, the computer operates in a closed-loop recirculating the value in its AC register. LSKP causes the loop to be skipped so that the next value is fed from the AC register. The control signal inputs, together with the instruction input are supplied to a bus supervisor 33 (FIGS. 5 and 6) which distributes the information it receives to the various devices in the synthesiser and in the interface. The data input LBAC is supplied to a driver and buffer circuit 34 (FIG. 7) which inverts the data input by means of twelve inverters (represented as a single inverter 35) to provide data BAC in 12 bit form which is delivered and to a variable modulo divider circuit 34 (FIG. 9) to a driver circuit 36 (FIG. 8). The data input from LBAC is distributed to these places in dependence upon the control signals at LBMB and the signals at IOP and BTS3 (BTS3 being a pulse defining the beginning of a computer cycle and IOP being pulses defining when LBMB can be read). The driver and buffer circuit 34 also produces data FTL, which is 16 bit data constituting programming information which is initially supplied to programme the various function generators. Data LAL and OSN from circuit 36 represents the incoming series of digitally coded words designating the amplitude changes and the frequency changes for the respective oscillators. Data A from circuit 34 defines the overall output level and the revelant one of the three analogue outputs for the digital-to-analogue converter 13. The distribution of the information from LBAC to these various inputs is in dependence upon the instruction data on inputs LBMB.

The signals LBMB define a variety of instructions which state the destination in the synthesiser and its interface for the incoming data LBAC from the AC register. As will become apparent, some of these destinations are registers in the interface, one of which is a register DOG (data register) in circuit 34 and another of which is a register CAT (counting address register) in the LAL and OSN driver circuit 36 (FIG. 8).

Figure 5:
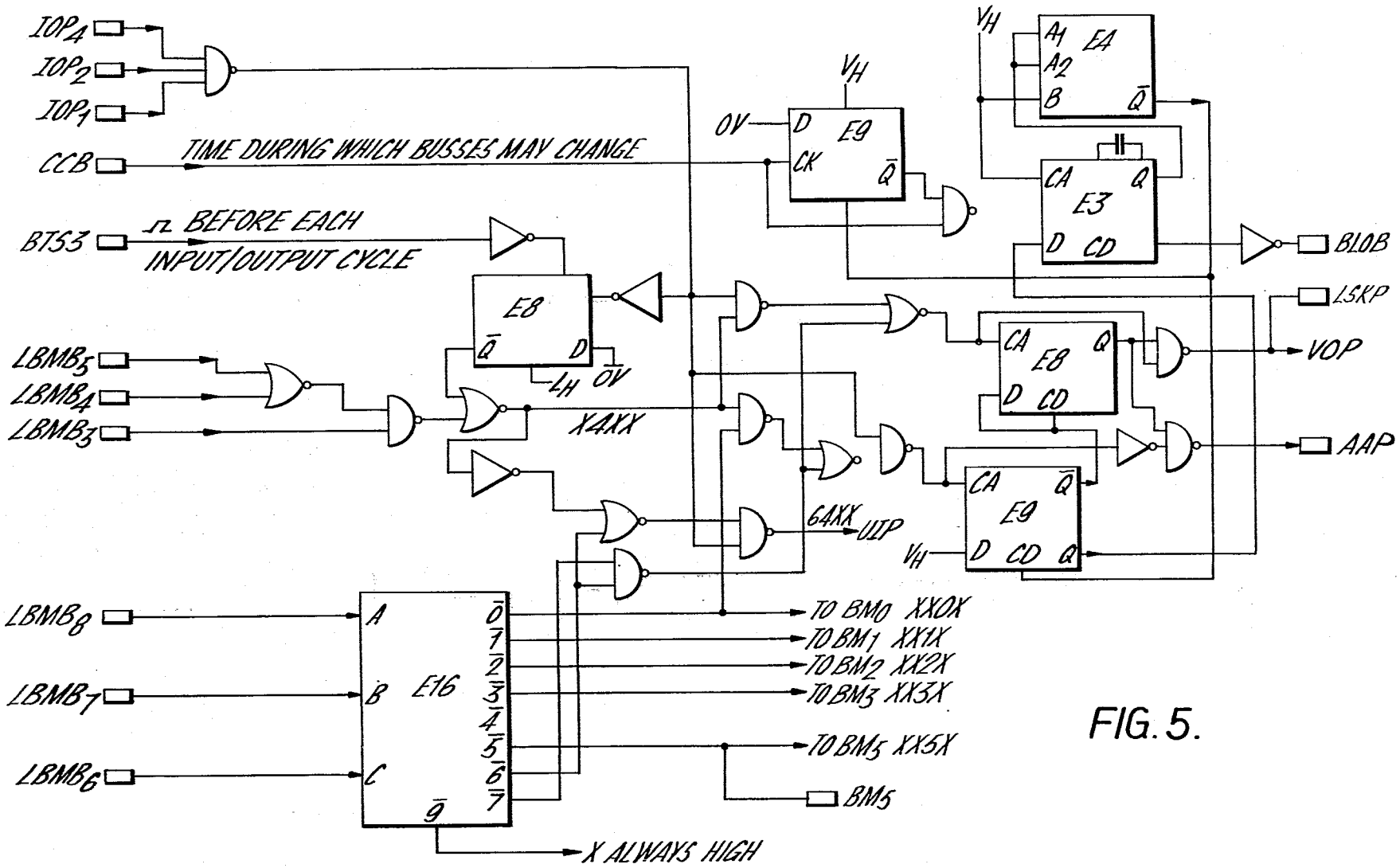
FIGS. 5 and 6 show a circuit diagram of a bus supervisor of the interface.
Figure 6:
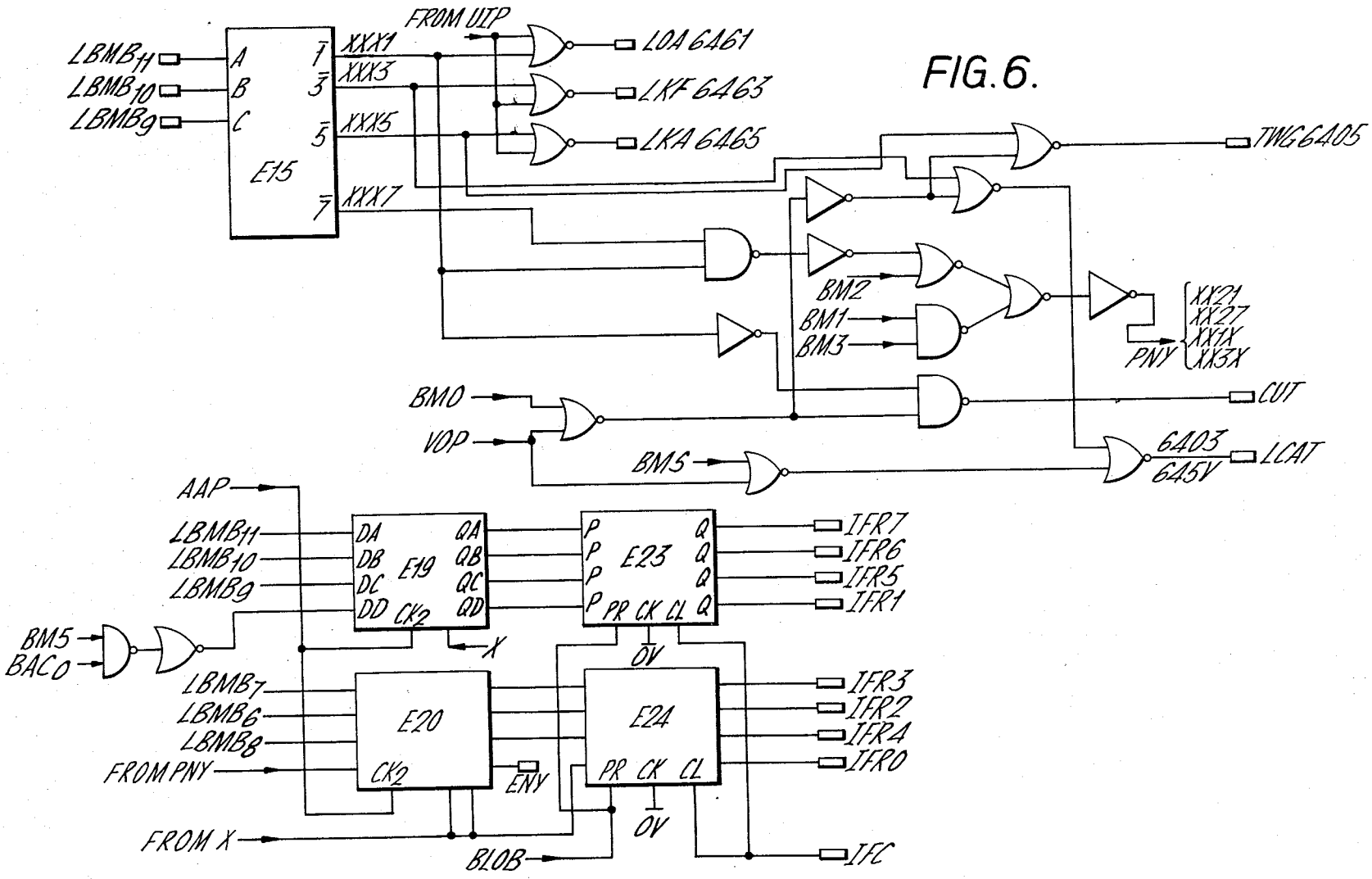

The bus supervisor receives the instructions LBMB and converts them into the signals noted in FIGS. 4, 5 and 6.

Figure 9:
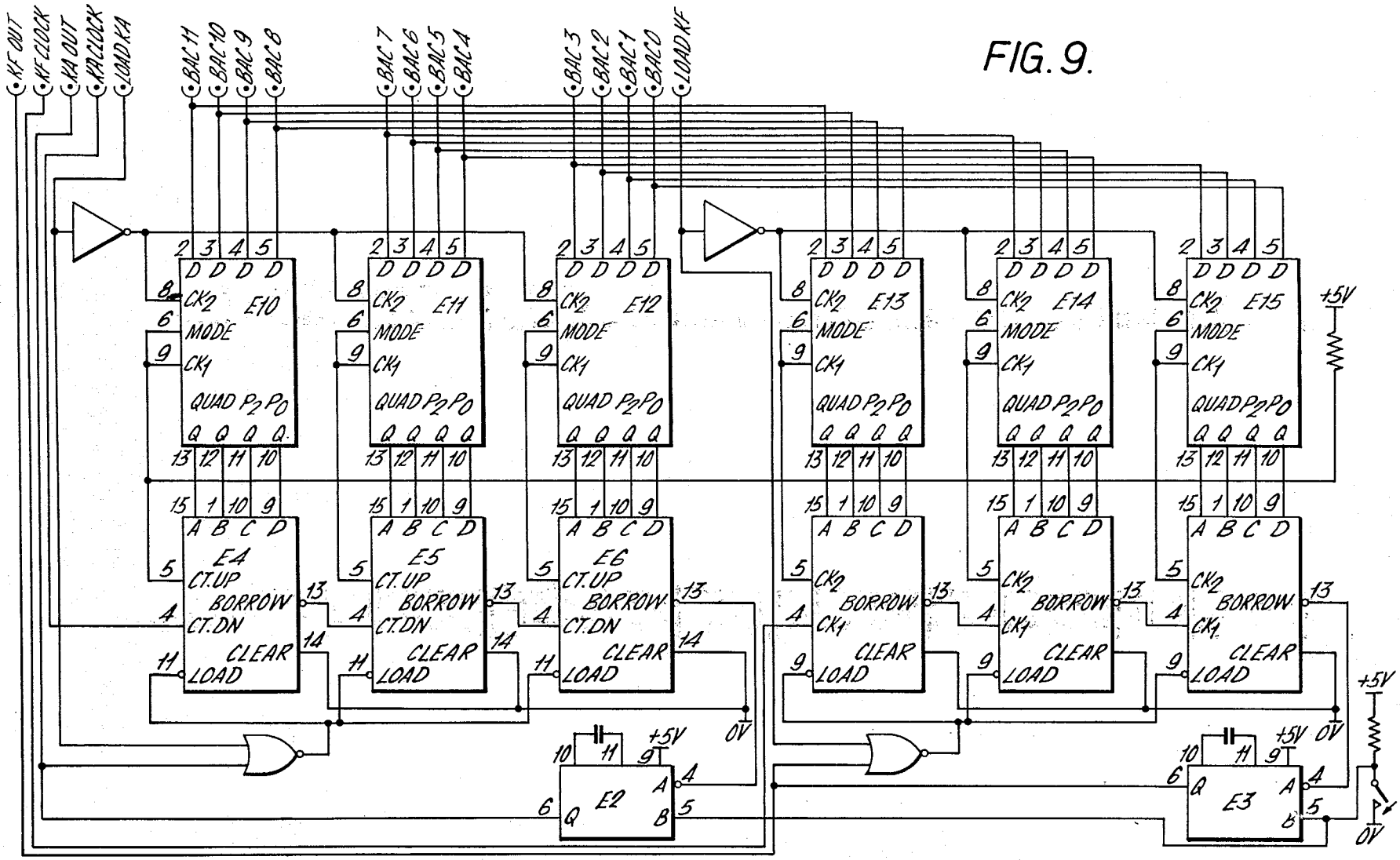
FIG. 9 shows a variable modulo driver circuit of the interface.

The instructions are as follows, those being prefixed by S causing the generation of LSKP.

a. S6401 — increment register CAT (content of AC irrelevant) — produces signal CUT;

b. S6403 — load AC into CAT — produces signal LCAT — used to provide from LBMB the waveform function generator address (LBMB2–11), the frequency function address (LBMB3–11), the amplitude function generator address (LBMB6–11) and the oscillator number (LBMB6–11) of the oscillator to receive data delivered according to subsequent code 6433, 6625, 6427 or 644V;

c. S641V (where V defines which of three voices A, B & C is concerned) — load waveform function generator from AC at address given by CAT — produces signal ENY — uses LBMB3–11, representing the data in 2's complement form with LBMB3 representing sign;

d. S6405 — load part of AC into DOG — produces signal TWG — uses LBMB8–11 to produce in DOG the four most significant bits of a sixteen bit word (FTL);

e. S6421 — load AC into DOG and write DOG in frequency function generator at address given by CAT — uses LBMB0–11 to give the remaining bits of the 16 bit word (FTL);

f. S6423 — load oscillator, selected by CAT, with frequency data in parametric absolute format from AC via the frequency function generator and the frequency interpolator — uses LBMB0–3 to give the logarithm of the slew time for the interpolator and LBMB3–11 to give the required new frequency. The logarithm of the slew time can be between 0 and 7 and this number determines how long the oscillator frequency will spend in transition between its present value and the new value given by the 9 bit frequency information, these 9 bits telling the oscillator which address in the frequency function generator holds the frequency to be reached at the end of the slew time. The slew operation makes the oscillator leaf through all the frequency function addresses between the current address ($P_O$) and the new address ($P_N$). The rate of movement is calculated in the synthesiser. The actual time taken (T) is related to the logarithm of the slew time (S) thus:

$T = K_F 2^{(S-1)}$ milliseconds, except where $S = O$, when $T = 0$. $K_F$ is the frequency slew time multiplier which is provided as a pulse repetition rate at the output RTF of a variable modulo divider circuit 37 (FIG. 9);

g. S6425 — as 6423 except that the new frequency is defined as the difference between $P_0$ and $P_N$ with LBMB3 being a sign bit; when a 6425 delivery arrives before the previous interpolation is complete, the new target $P_n$ is calculated from the previous target and the slew rate from the present value;

h. S6427 — load AC into the 12 bits of DOG remaining after 6405 and deliver whole of DOG to control the frequency of the oscillator designated by CAT — this instruction bypasses the frequency function generator as far as the selected oscillator is concerned;

i. S643V — load amplitude function generator selected by V with data from AC at address given by CAT — used LBMB4–11;

j. S644V — load oscillator selected by CAT with amplitude data from AC — use either a linear format defined by a '1' at LBMB0 (c.f. $BAC_0$ input to circuit 32) and having amplitude data at LBMB4–11 (selected oscillator moves immediately to the new amplitude bypassing the amplitude function generator) or a parametric format defined by a '0' in LBMB0 and having Log slew time at LBMB2–5 and the new amplitude at LBMB6–11 giving the address of the amplitude function generator from which the oscillator will obtain its 8 bit amplitude data at the end of the slew time. The required slew time $T = K_A 2^{S-1} K_A$ is a slew time constant defined by a pulse repetition rate at RTA of circuit 37;

k. S645V — an alternative to S644V in which LBMBO–5 defines one oscillator address, LBMB6–8 defines log slew time and LBMB9–11 defines the three most significant bits for the address of the amplitude function generator, the other bits being zeros, although the slew operation will leaf through all intervening values before it arrives at the new value — in this mode, the slew time equals the time between successive deliveries of LBMB;

The remaining three instructions relate to asynchronous deliveries requiring no skip.

1. 6461 — load output amplifiers — produces signal LOA — LBMB0–2 defines one of three voices, LBMB3 defines dynamic range and LBMB6–11 defines overall output level;

m. 6463 — load frequency slew time factor $K_F$— produces signal LOAD $K_F$— 12 bit definition of $K_F$;

n. 4665 — load amplitude slew time factor $K_F$— produces signal LOAD $K_F$— 12 bit definition of $K_F$.

As will be apparent from a study of the circuits concerned, various of these instructions set up, from supervisor 32, signals 1FR0-14 7 which are converted in the synthesiser into control signals designated GUV and directing the data as set forth above.

FIGS. 5 to 9 show the circuits of the interface.

FIG. 5 shows the production of signals in dependence upon the pulses IOP, the signal CCB, the signal BTS3 and bits 3 to 8 of the instruction LBMB. In this figure has been noted the signal paths which are responsive to particular digits and digit combinations in the instructions.

Certain of the signals from FIG. 5 are utilised with the LBMB instruction and the signal BAC0 to produce further control signals including the set of signals IFR in FIG. 6.

In FIG. 5, the components are as follows, the type numbers given here and throughout the Specification being those used by Texas Instruments unless otherwise stated, E3 and E4 one shot multivibrators type 74,121, E8 and E9 D-type bistable circuits type 7,474 and E16 a decoder type 7,442.

In FIG. 6 the components are as follows, E15 a decoder type 7,442, E19 and E20 shift registers type 7,495 and E22 and E23 shift registers type 7,496.

Figure 7:
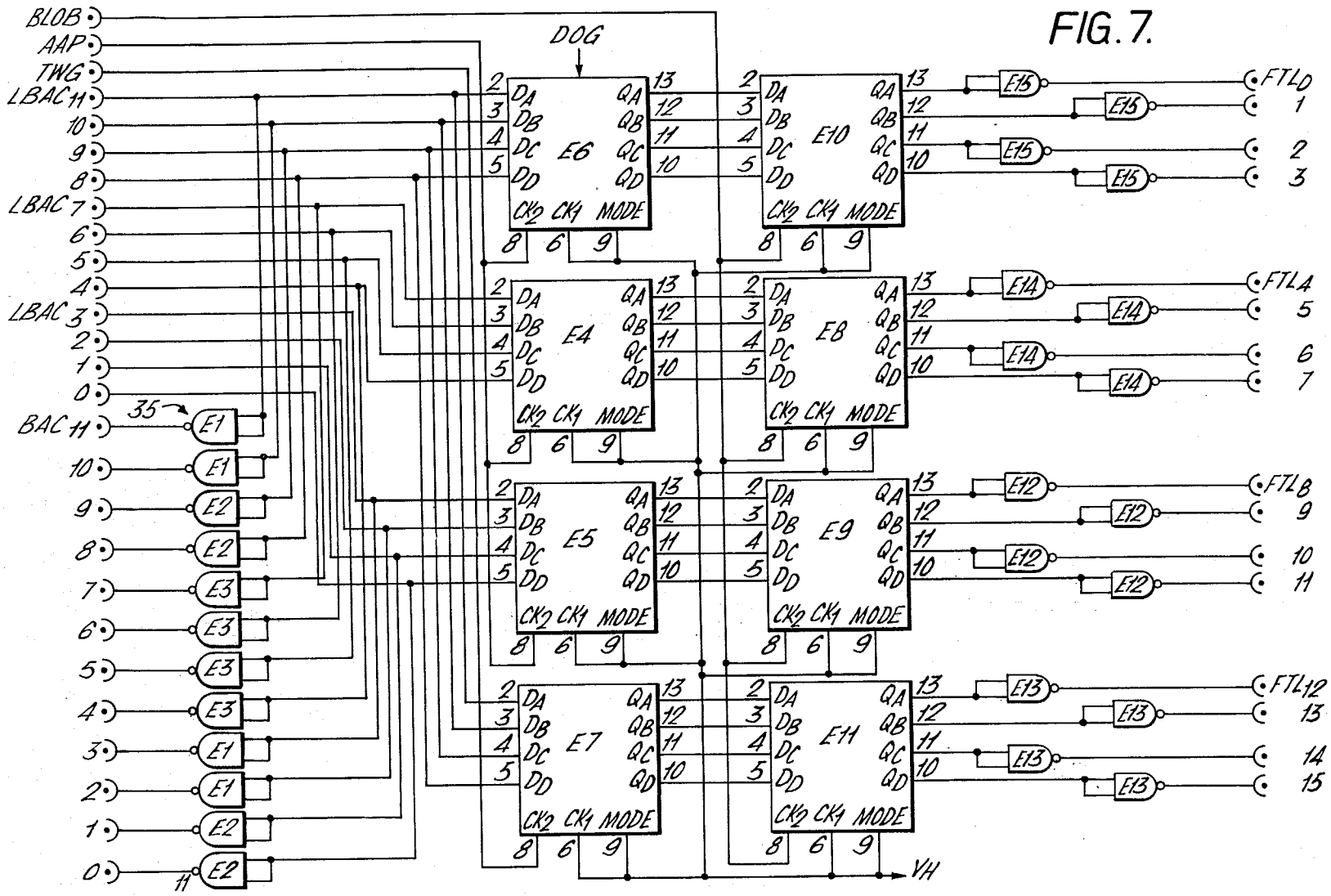
FIG. 7 shows a circuit diagram of a driver and buffer circuit of the interface.
Figure 8A:
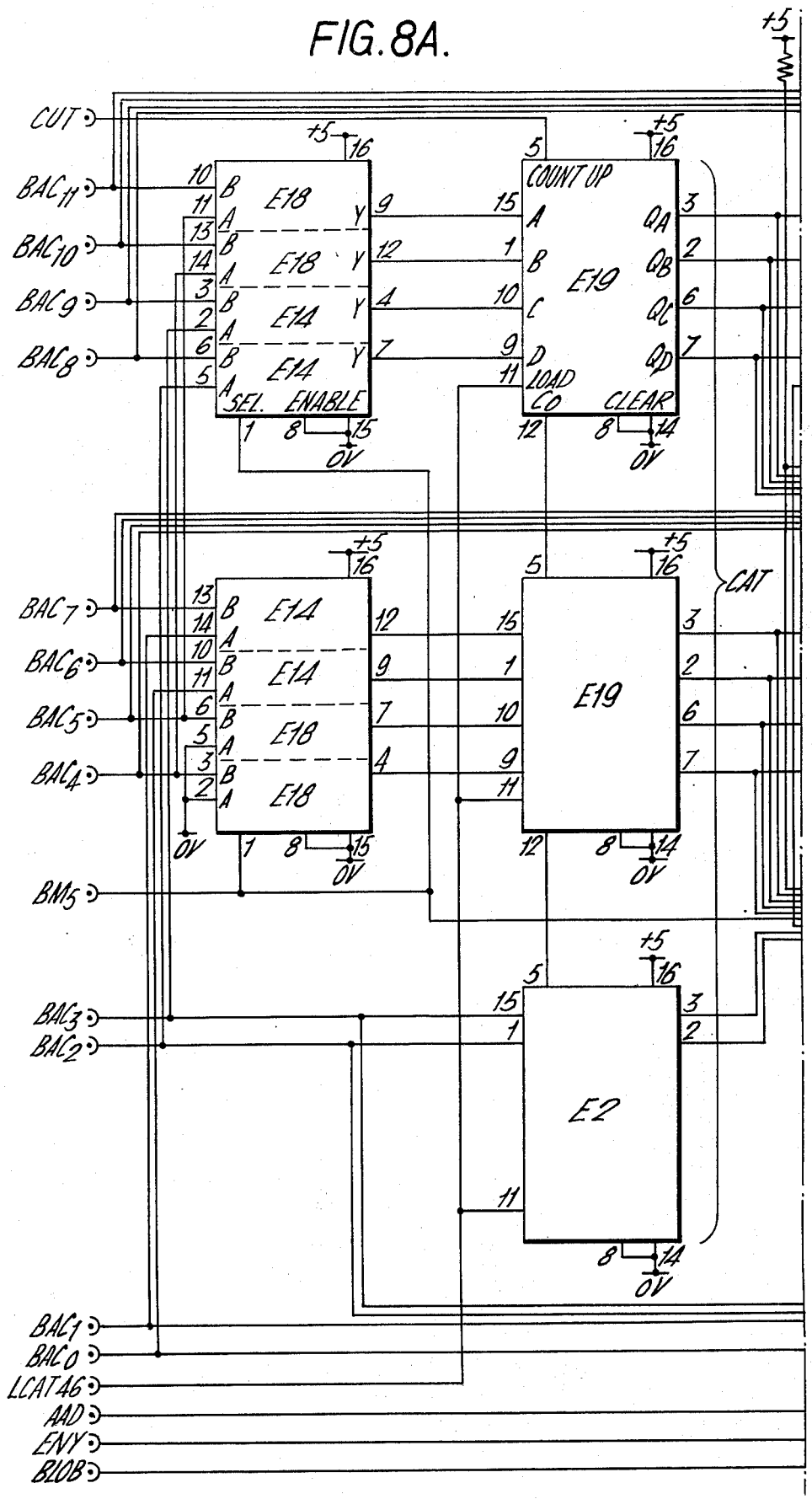
FIGS. 8A, 8B, 8C show a signal driver circuit of the interface.
Figure 8B:
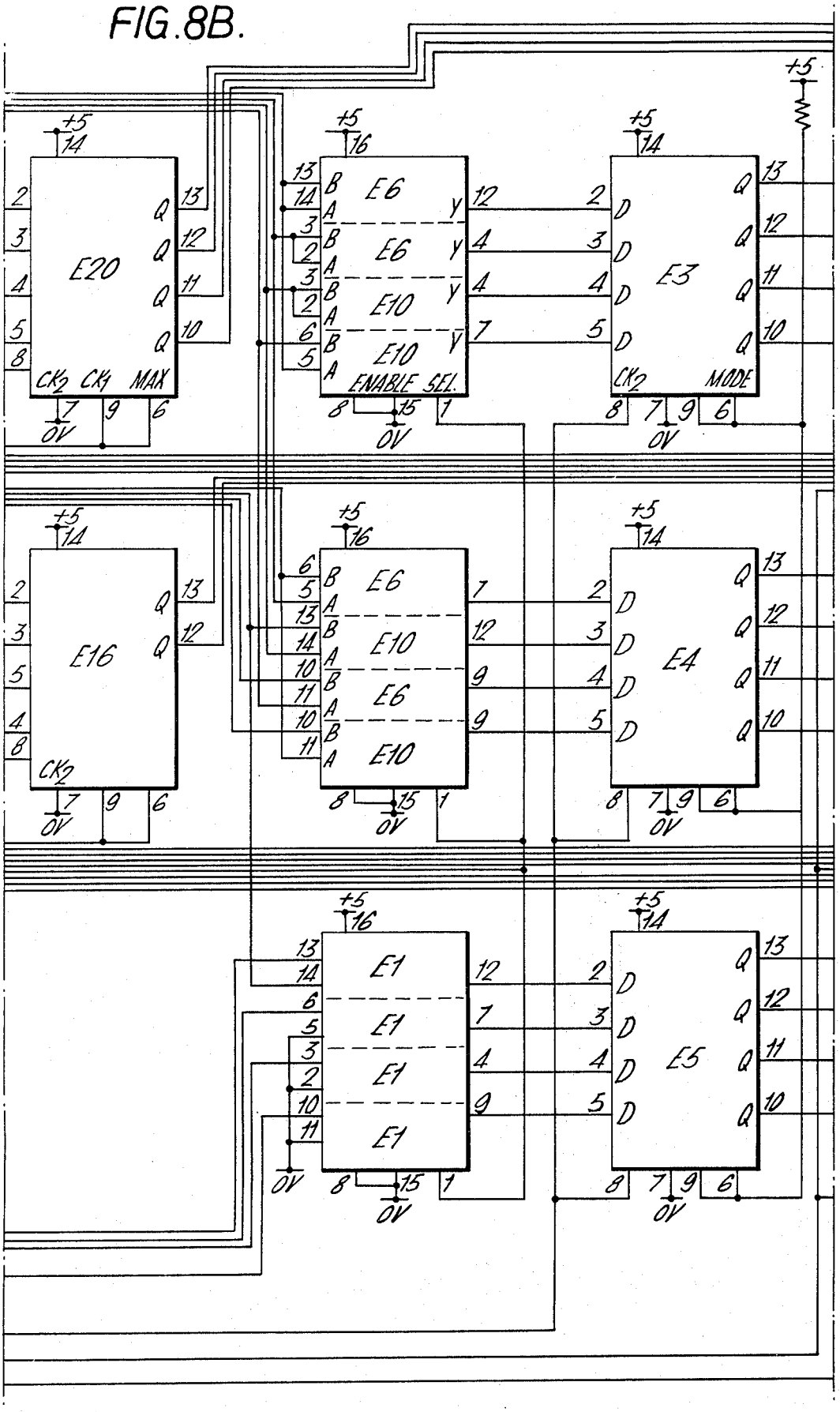
Figure 8C:
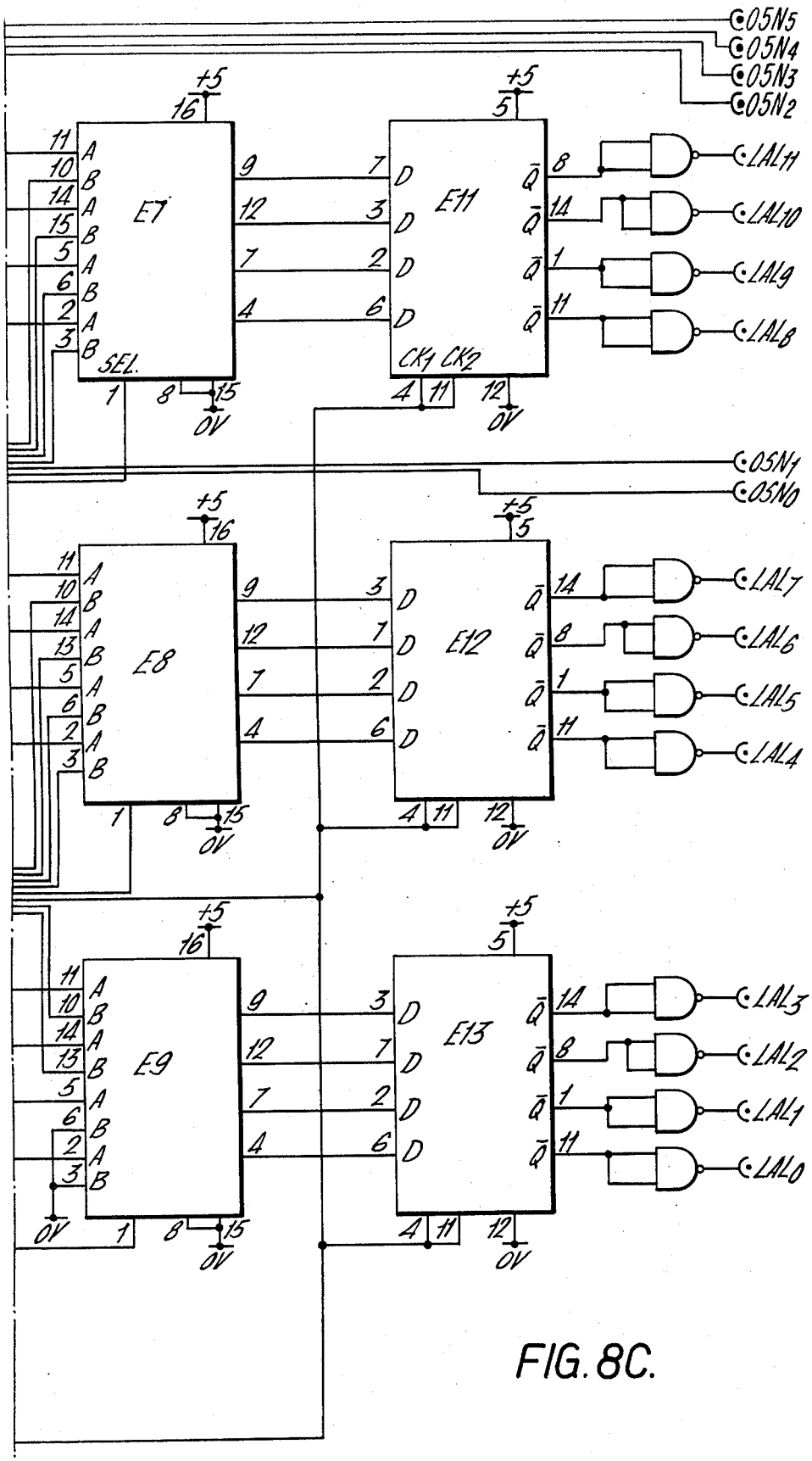

FIG. 7 shows the circuit diagram of the driver and buffer circuit 34 receiving data LBAC and emitting that data via inverters 35 at output BAC0–11. The data LBAC is also applied to the register DOG and from there to a register FTL whereafter it is inverted and supplied to the FTL output of the circuit. The components E4 to E11 in this circuit are shift registers type 7,495.

FIG. 8 shows a signal driver circuit providing the signals OSN and LAL. This circuit receives data BAC and sends it on alternative data paths, depending upon the control signal supplied to the circuit, to outputs LAL and OSN. Components E14 and E18 (type 74,157) multiplex two different arrangements of the BAC data in dependence upon control signal BM5 and the data therefrom is supplied to the register CAT (components E2, E15 and E17, type 74,193) under control of signal LCAT. The register CAT has its outputs connected to a register E16 and E20 of type 7,495 under control of the signal BLOB and the output of this register is connected to the OSN outputs. The output of the CAT register is also connected to a multiplexer E7 to E9 (type 74,157) under control of signal ENY and the output of the multiplexer is fed to a register E11 to E13 (type 7,479) the output of which is connected to the LAL output.

The BAC inputs are connected to a further multiplexer E1, E6, and E10 (type 74,157) which is under the control of signal BM5. The output of this multiplexer feeds a register E3 to E5 (type 7,495) which is controlled by a signal AAP and the output of which is connected to the multiplexer E7 to E9.

The output OSN provides address information for 64 word memories within the synthesiser and the output LAL provides the address for larger memories in particular those in the function generators. The data FTL from the circuit 34 provides the data associated with the LAL addresses whilst the LAL outputs also provide data under some conditions, this being the data associated with the addresses given by OSN.

FIG. 9 shows the circuit diagram of the variable modulo divider circuit 37. This circuit is fed with data from BAC when it represents the respective slew factors, this data being fed into registers E10 to E12 and E13 to E15 (type 7,495). The data from these registers is supplied under the control of the respective KF and KA load signal to two counters E4 to 6 and E7 to 9 (type 74,193) which are counted down by $K_F$ and $K_A$ clock pulses at 512 KH and 64 KH respectively. The resulting output trains are processed by multivibrators E2 and E3 (type 74,121) and are fed to the respective KF and KA outputs for use by the interpolators.

FIGS. 10 to 13 illustrate the interconnection of printed circuit boards which, together with certain timing circuits to be described hereinafter, constitute the synthesiser proper.

Figure 10:
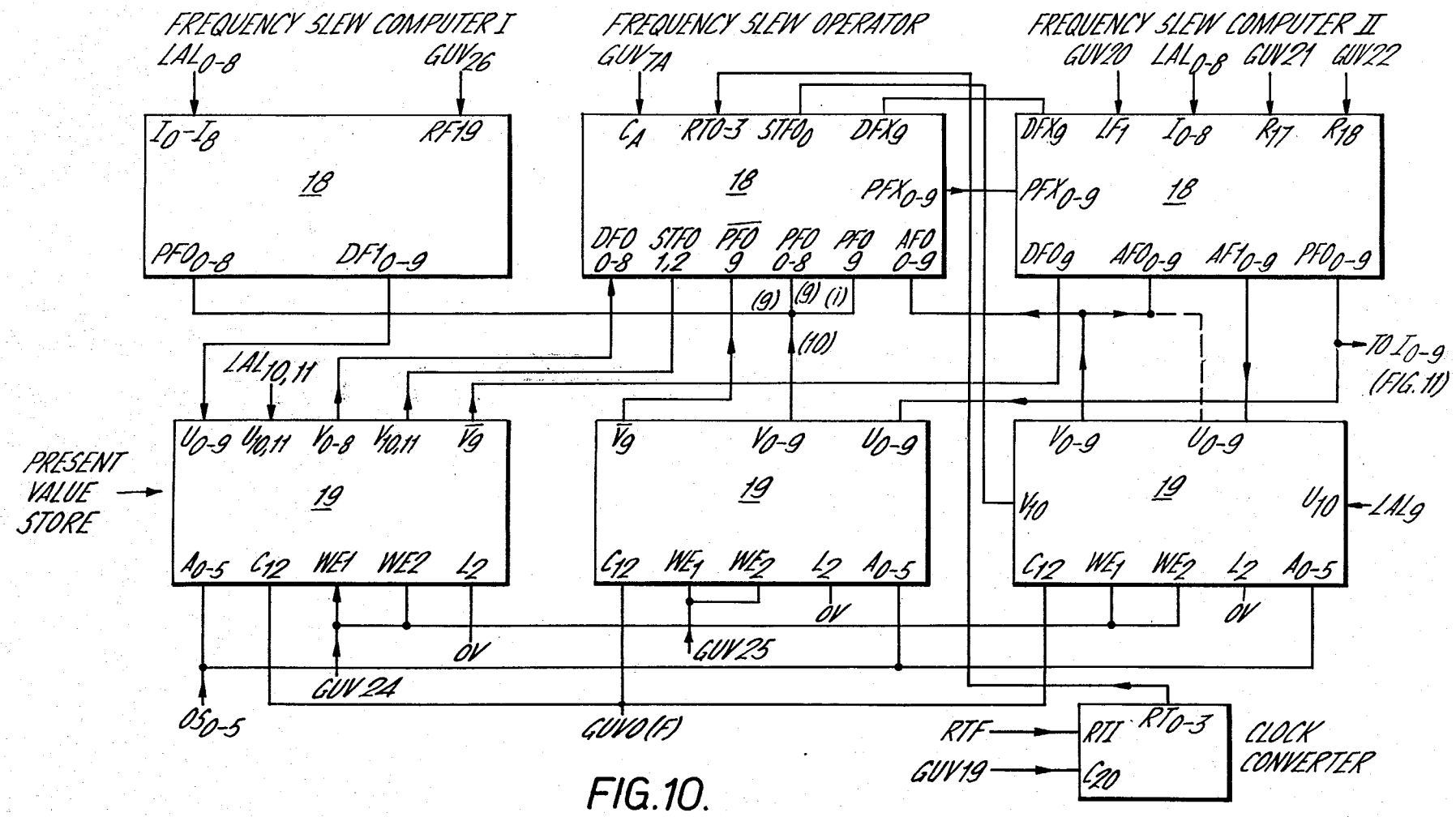
FIG. 10 shows circuit boards including a frequency interpolator.

FIG. 10 illustrates items 18 and 19 of FIG. 2, i.e. the frequency interpolator and its present value store. This interpolator is described in an application being filed concurrently herewith in the name of Peter Charles Eastty, order 19,781, so its details will not be further described here, except for the present value store 19 individual parts of which will be described hereinafter.

Figure 11:
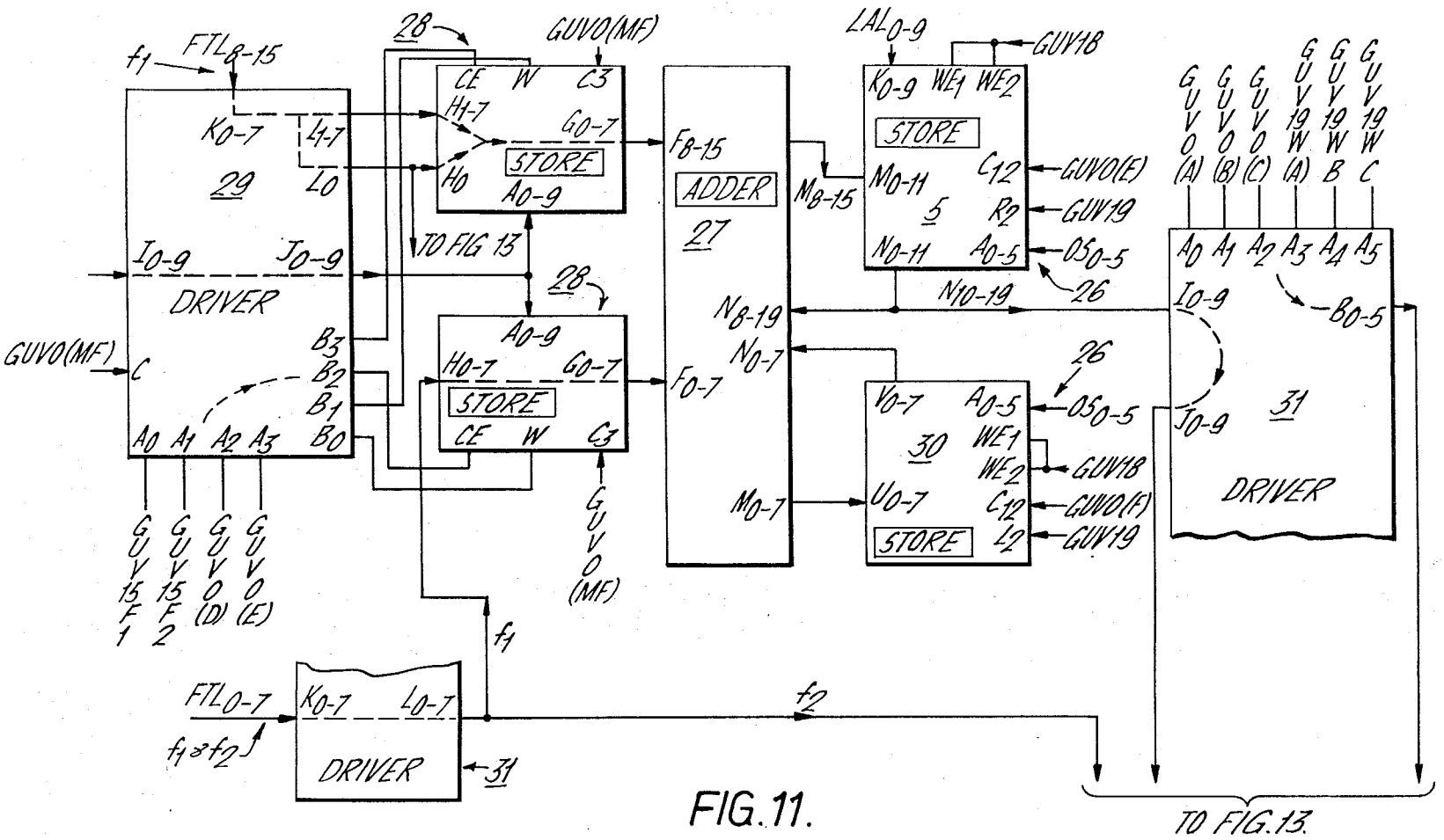
FIG. 11 shows circuit boards including digital oscillators.

FIG. 11 corresponds to FIG. 3 and thus illustrates the oscillators 8.

Figure 12:
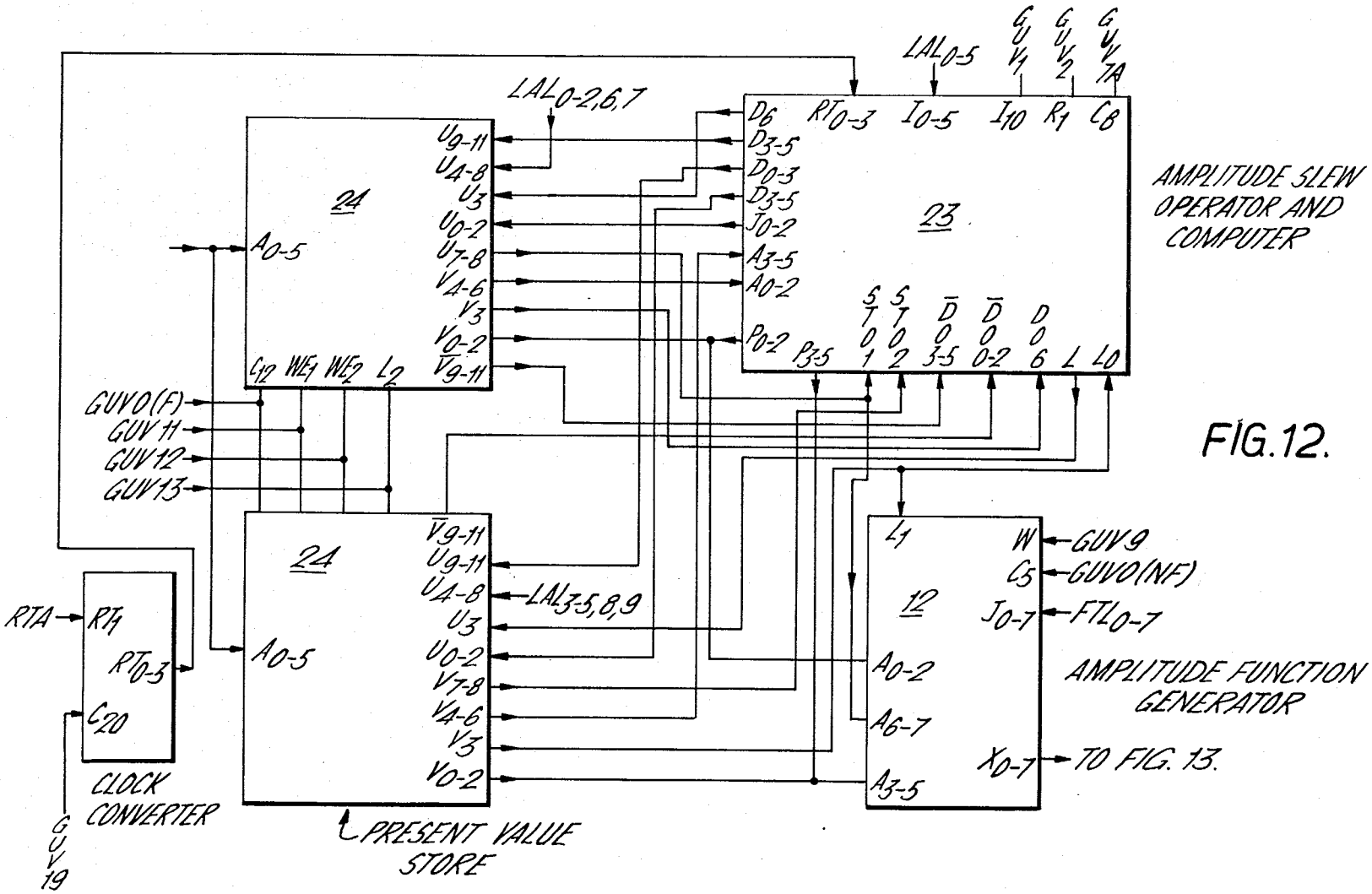
FIG. 12 shows circuit boards including an amplitude interpolator.

FIG. 12 illustrates the amplitude interpolator 23 with its present value store and function generator 12 and again this is described in more detail in the above-mentioned copending Application. Accordingly, hereinafter only circuit boards 12 and 24 will be described in detail. As will be apparent the circuitry of FIG. 12 is triplicated for the respective voices A, B and C.

Figure 13:
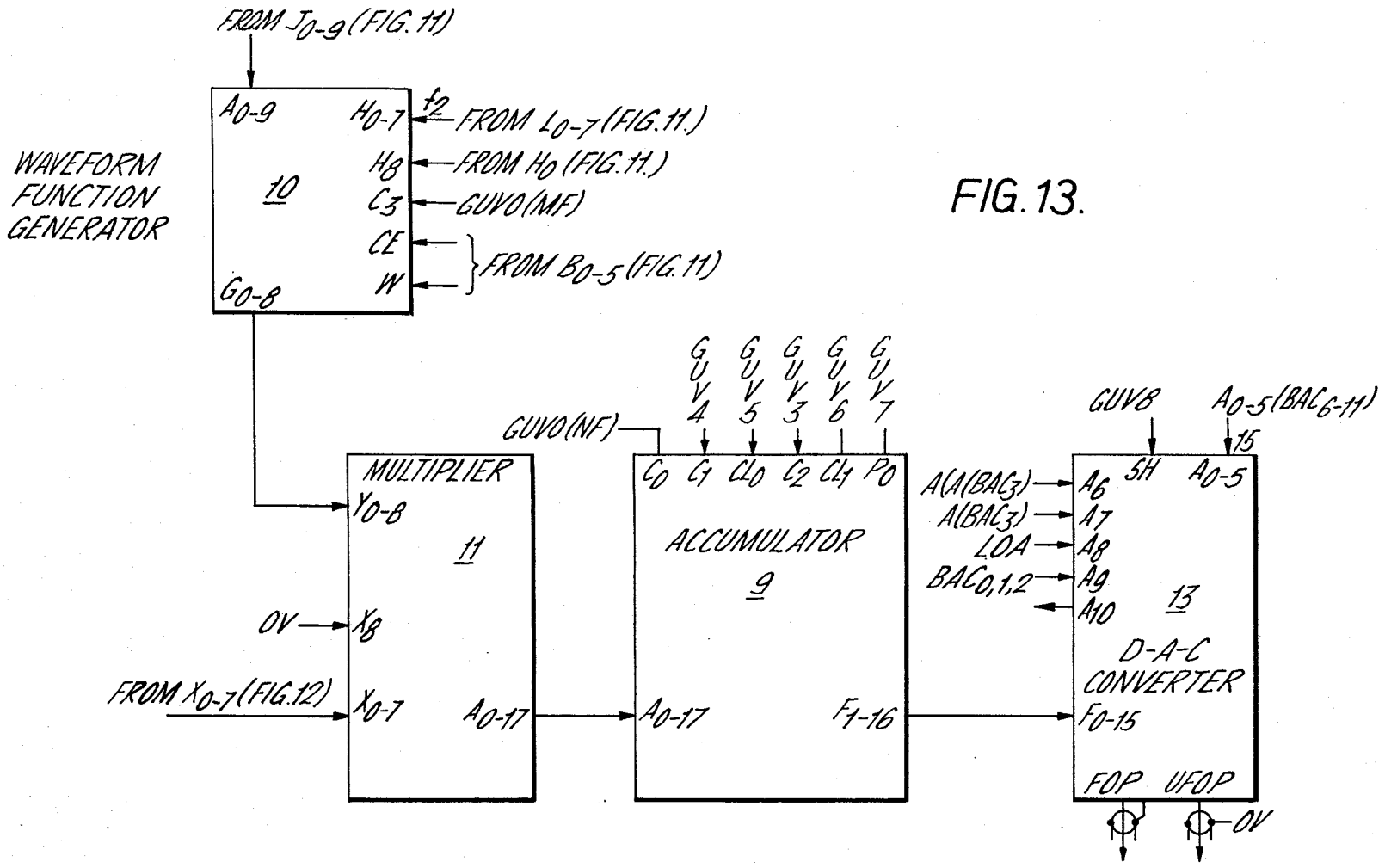
FIG. 13 shows circuit boards providing output components of the synthesiser.

FIG. 13 illustrates items 9 to 11 and 13 of FIG. 2 and again it will be apparent that the circuitry of this figure is provided in this embodiment in triplicate for the respective voices A, B and C. It should be made clear that the signals CE and W to circuit 10 are derived from signals B0 to 5 of FIG. 11 in that for voice A the signals B0 and B3 are utilised, for voice B signals B1 and B4 and for voice C signals B2 and B5. Attention is also drawn to the control signal GUV3 entering circuit 9. As will appear later this signal is produced in three forms, GUV3 A, B and C. This signal GUV3 will therefore be selected from the three GUV3 signals according to the voice concerned. A similar principle is to be adhered to when other control signals are produced in triplicate and are suffixed by A, B and C.

For a better understanding of FIGS. 10 to 13 some typical signal paths will now be indicated. Firstly the amplitude function generator 12 will be considered, this component appearing in FIG. 12. The data for the amplitude function table arrives on the data lines. FTL0-7 applied to the inputs J0–7 of the generator 12. This generator, being in the form of a memory, requires appropriate addressing for the successive pieces of data and this addressing is applied to its inputs A0–7 from data lines LAL0–5 applied to the circuit board 23. From this circuit board this address data passes via its outputs J3–5 and STO 0, STO1 and P0-2, in the former case via the lower circuit board 24 and in the other cases directly to the A inputs of the circuit 12.

The waveform function generator 10, appearing in FIG. 13, will now be considered. The data for the waveform function table to be charged in this generator arrives on data channels FTL0–7 applied to circuit board 31 of FIG. 11 and data channels FTL8–15 applied to circuit board 29. As will appear later, this data applied to circuit boards 29 and 31 is amplified therein before being supplied directly to the generator 10. The address information for the generator 10 appears on its inputs A0–9 from output lines J0–9 of circuit board 31 of FIG. 11 having been applied thereto by circuit board 5 receiving the data on data channels LAL0–9.

Figure 14:
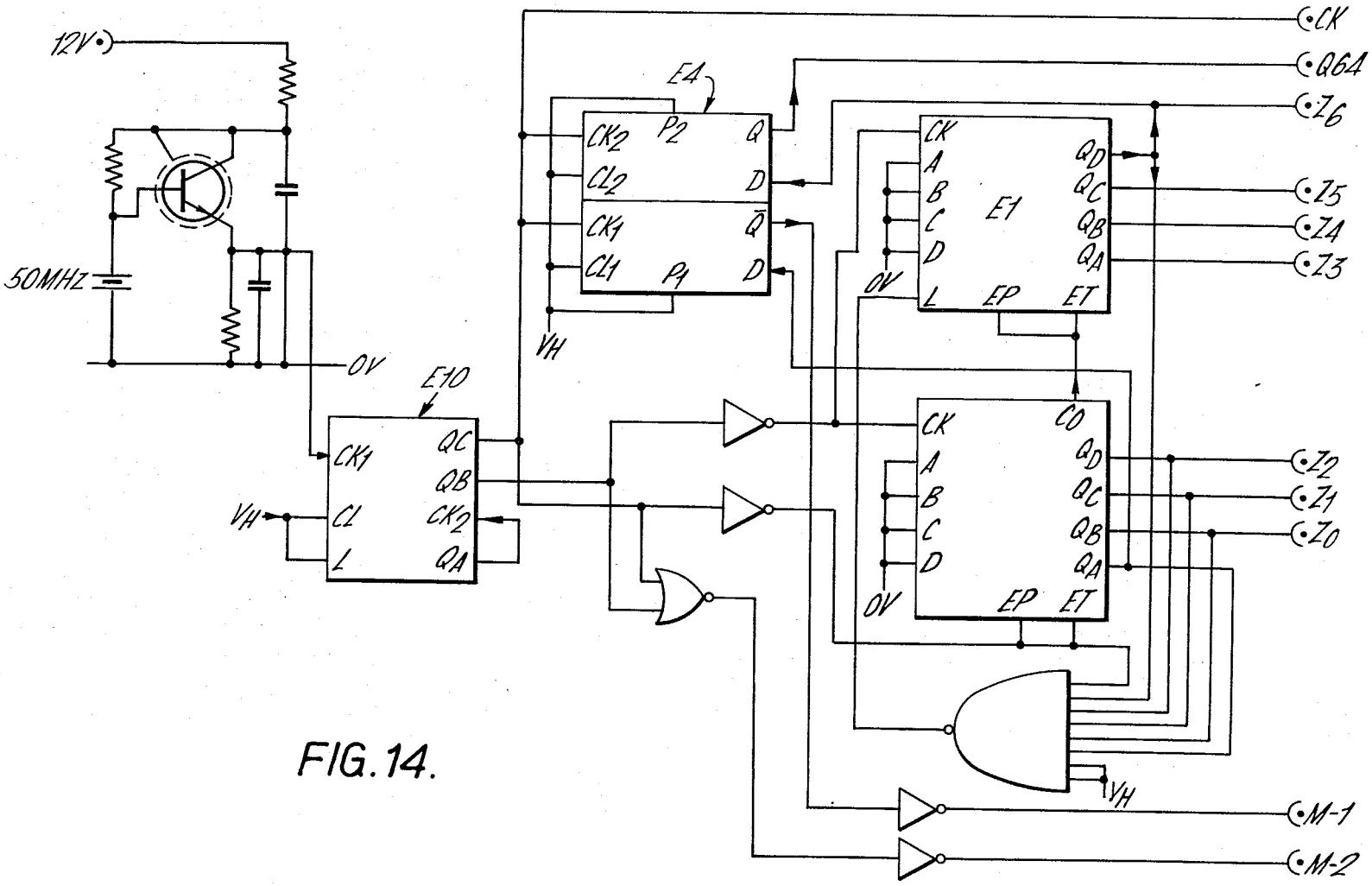
FIG. 14 shows the circuit of a master oscillator.
Figure 15A:
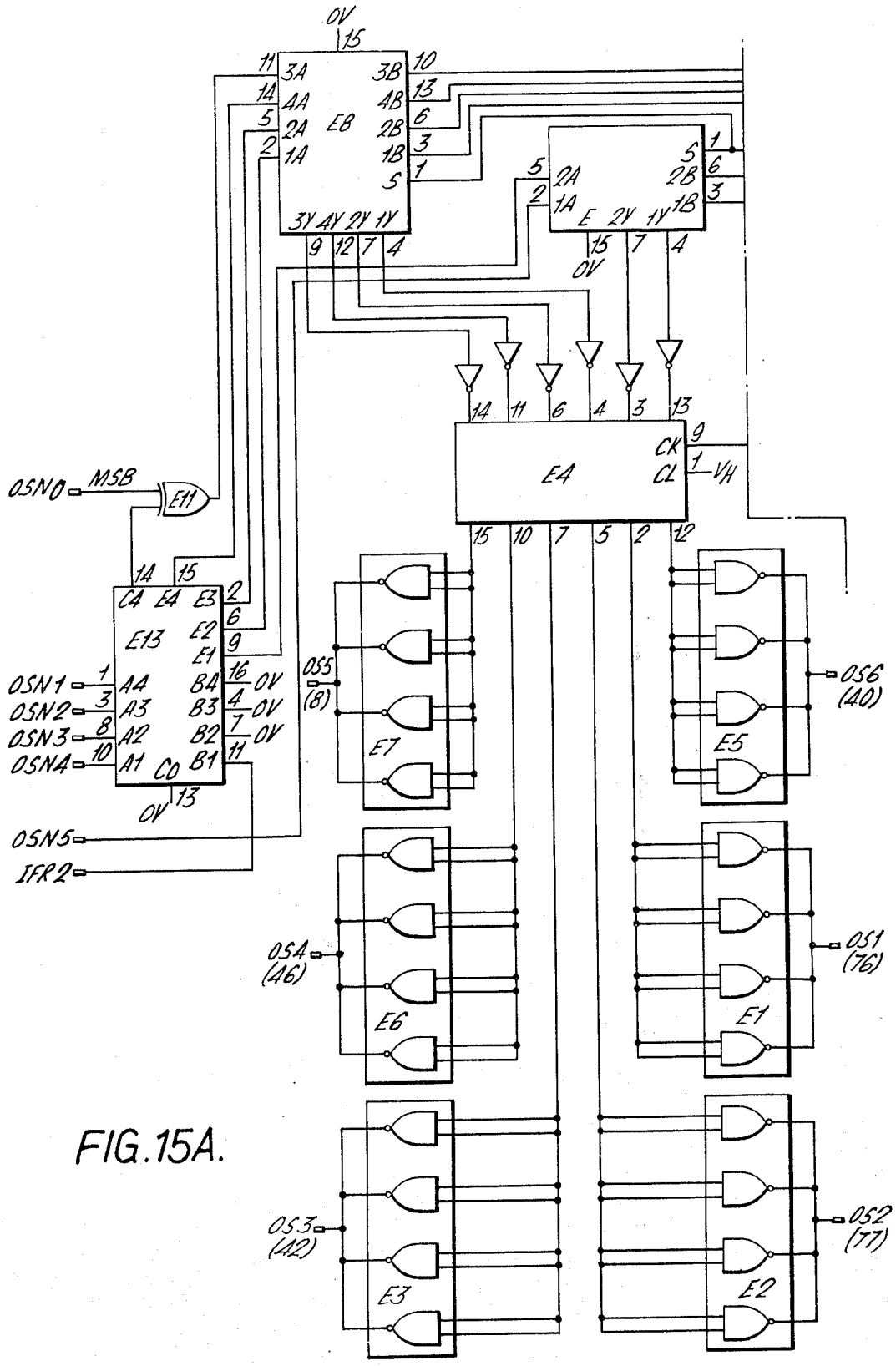
FIGS. 15A, 15B, 16, 17 show the circuits of three timing circuit boards.
Figure 15B:
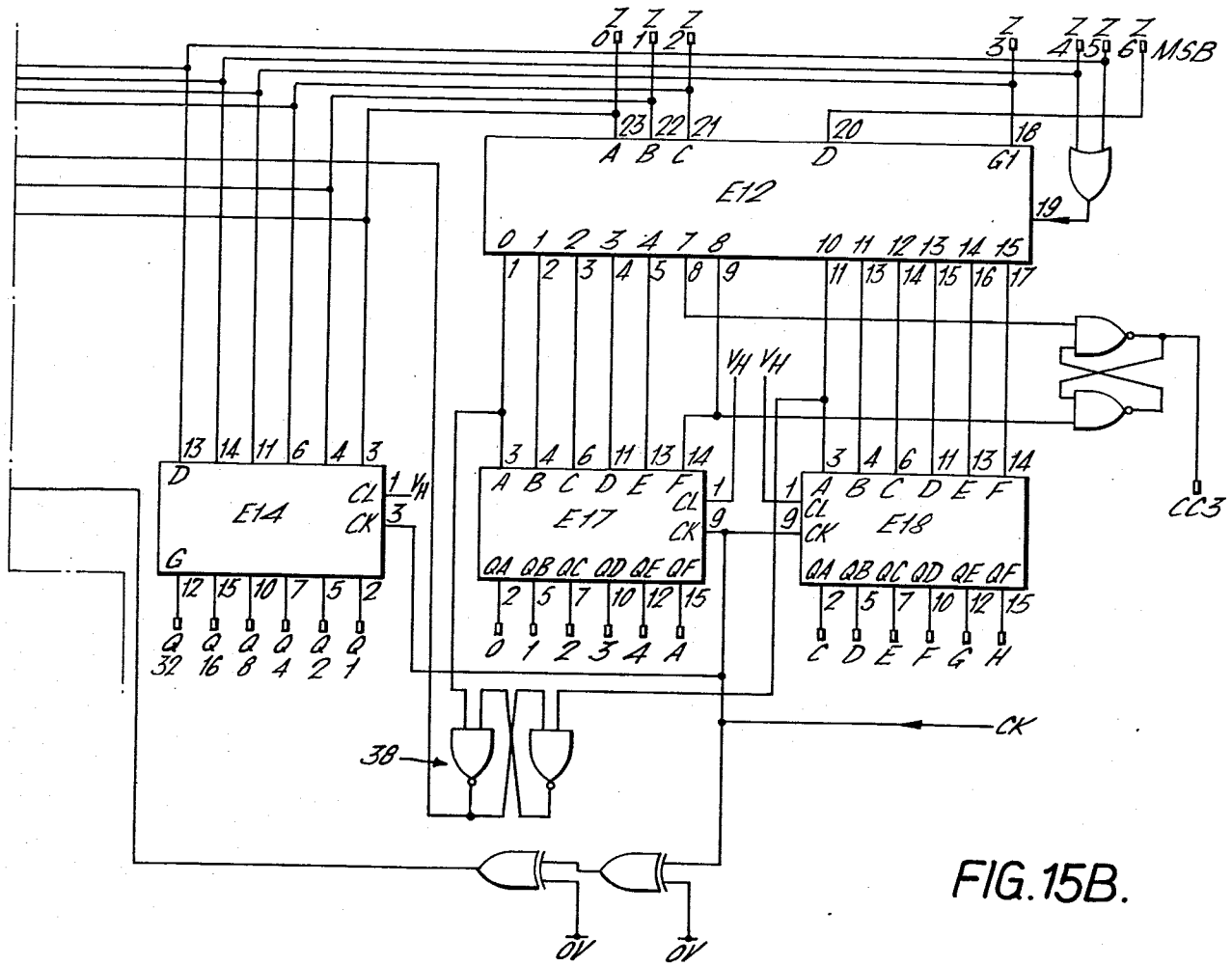
Figure 16:
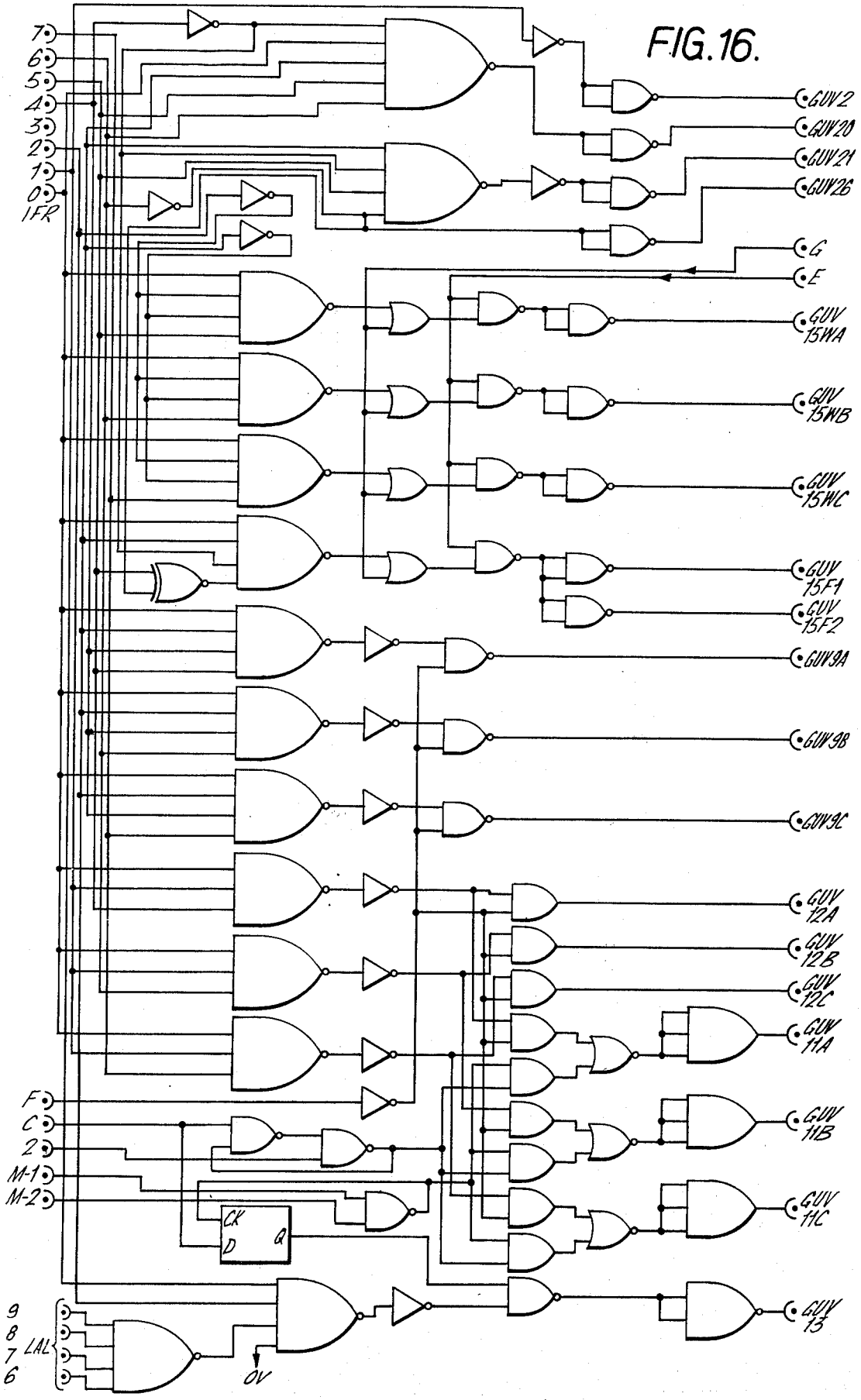
Figure 17:
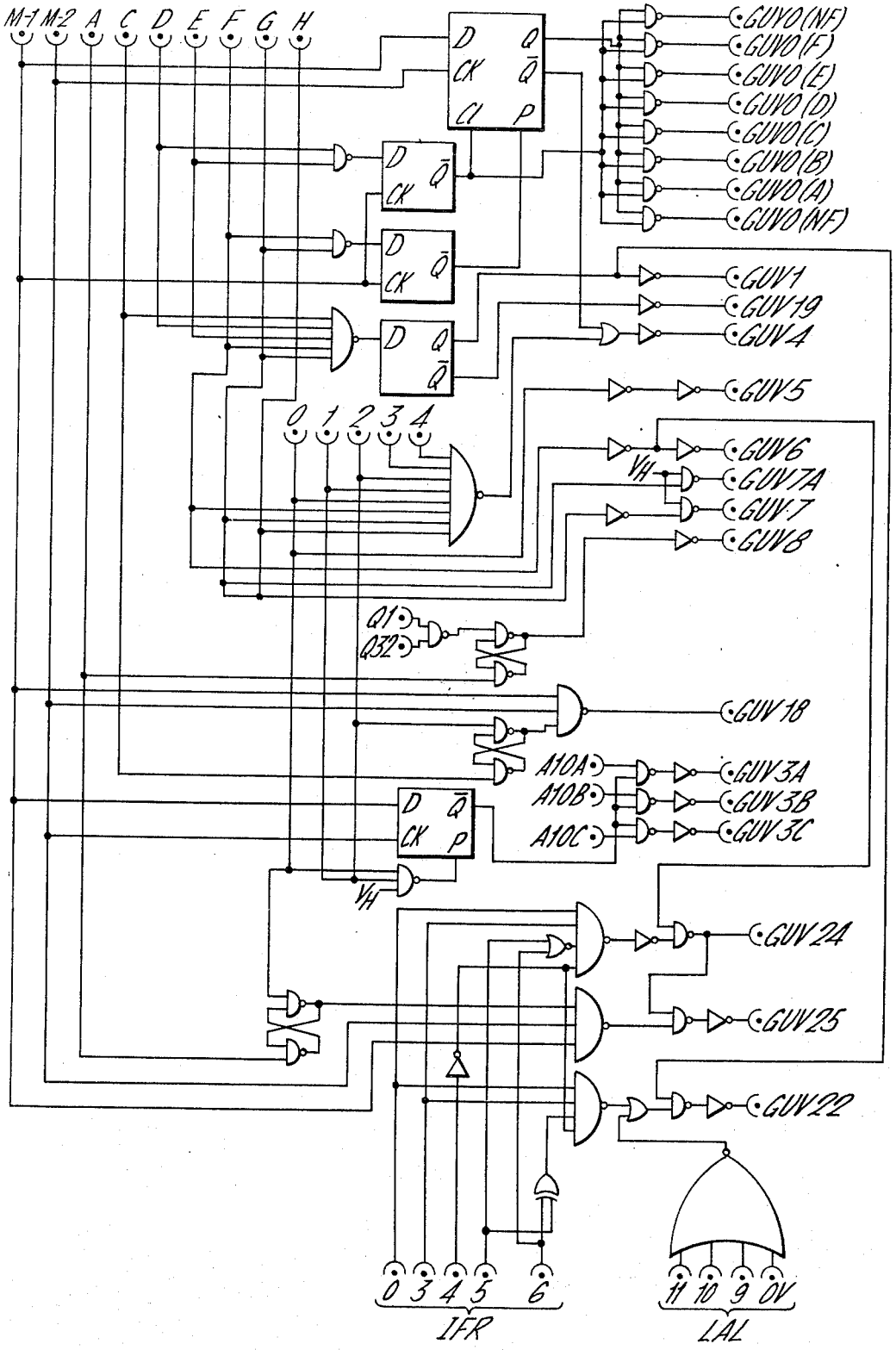

Further circuit boards of the synthesiser are a master oscillator (FIG. 14) and three timing circuit boards (FIGS. 15 to 17).

The master oscillator shown in FIG. 14 comprises a transistor crystal oscillator operating at 50 MHz and feeding into a component E10 which is a 4 bit binary counter (type 74,197) connected to divide the oscillator frequency by four at the QB output and to divide it by 8 at the QC output.

The circuit also comprises a component E4 (type 7,474) containing two D-type bistable circuits clocked by the signal from QC of component E10. The circuit further comprises what is effectively a 72 state counter giving digital timing outputs Z0 to Z6. This counter is constituted by components E1 and E2 both of which are of type 74,161 and each of which is a synchronous 4 bit counter. In addition to the Z outputs the circuit provides a clock output CK at the frequency delivered by output QC of component E10, a resetting signal Q64 from component E4, which signal is a delayed version of Z6, and timing signals M—1 and M—2 which are subdivisions of the timing pulses from output Z0.

FIG. 15 shows a first of the timing circuit boards. This board receives the timing signals Z from the master oscillator and also the addressing signals OSN and feeds one or other of them to outputs OS in dependence upon the state of multiplexers E8 and E9 (type 74,157). In one state of the multiplexers the outputs OS deliver the data on the data lines OSN and in the other state the outputs OS deliver counts derived from the timing signals Z for the purpose of sequential addressing, e.g. when the 64 oscillators are addressed one at a time in a fixed sequence. A bistable array 38 provides the signal which changes the state of the multiplexers. The OSN signals are received by a component E13 which is of type 7,483. The signals from the multiplexers are supplied by inverters to a component E4 which is of type 74,174. The Z signals are also supplied to components E14, E17 and E18 also of type 74,157 which distribute these pulses so as to produce further timing signals Q1, Q32, 0 to 4 and A to H. The components E17 and E18 are fed from a decoder component E12 (type 74,154) fed by the Z signals.

FIG. 16 shows a second of the timing circuit boards which in this case is fed by signals LAL6–8, timing signals from the master oscillator and signals from the timing circuit board of FIG. 15. By means of the illustrated logic gates and the D-type bistable circuit, various of the GUV control signals are produced for controlling the operation of other circuit boards.

FIG. 17 shows the third timing circuit board producing further of the GUV control signals in dependence upon timing signals from the timing circuit board of FIG. 15 and from the master oscillator and also in dependence upon signals LAL9 to 11 and signals A10 derived from circuit board 13 of FIG. 13. In this case certain of the GUV signals are of the type GUV0 and these all coincide in time for the synchronous clocking of data through the various components of the circuit boards.

Figure 18A:
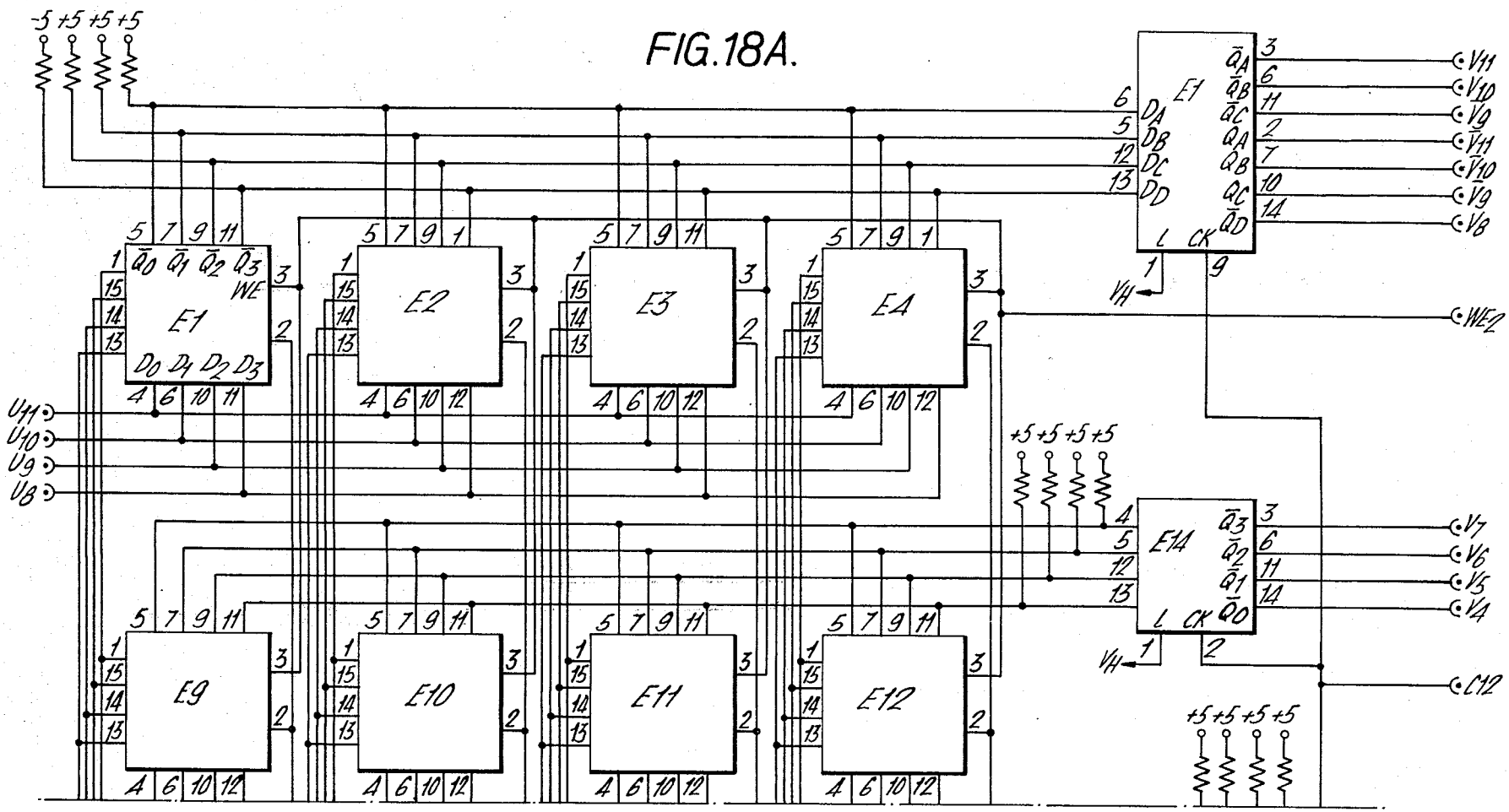
FIGS. 18A, 18B show a circuit diagram of a store.
Figure 18B:
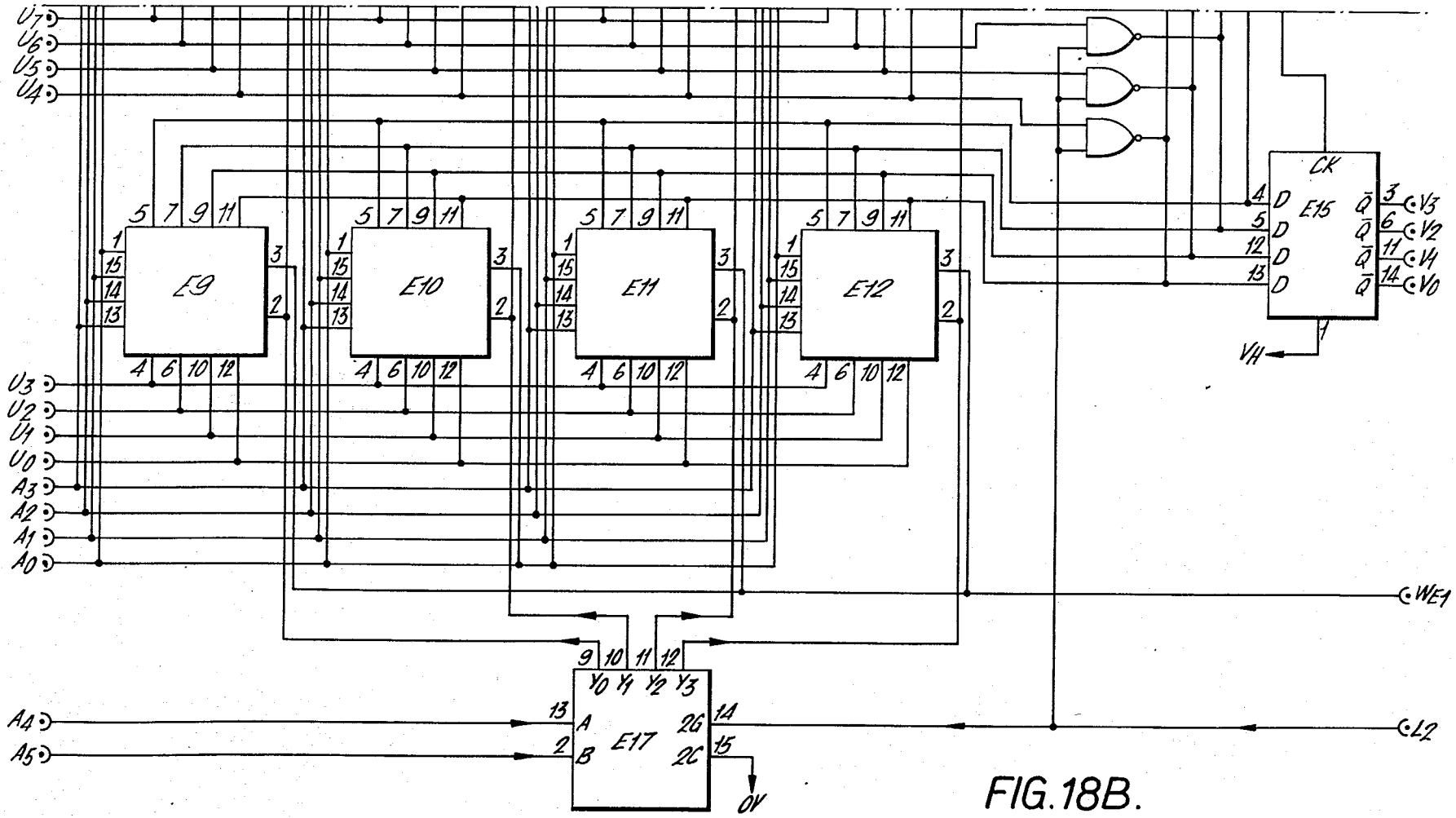

FIG. 18 is a circuit diagram of a 64-word, 12-bit, store of which several exist in the synthesiser, three at 19 for the present value store for the frequency interpolator, two at 24 for the amplitude interpolator and one at 30 for storing oscillator values.

In the form as illustrated in FIG. 18, it is suitable as the present value stores, but in the case of item 30, components E1 to E4, E13 and the gates feeding component E15 are omitted.

Storage is by way of 12 components E1 to E12 of type 7,489. Data is supplied to the store at inputs U0-11 and the outputs are taken via components E13 to 15 (type 74,175) to outputs V0 to V11. Address information is supplied at inputs A0–5 some of the bits of which enter the circuit by way of a component E17 of type 74,155 and constituting a two-line to four-line decoder. The inputs WE1 and WE2 are write enable inputs and C12 is a clock input receiving a GUV0 control or timing signal.

Figure 19:
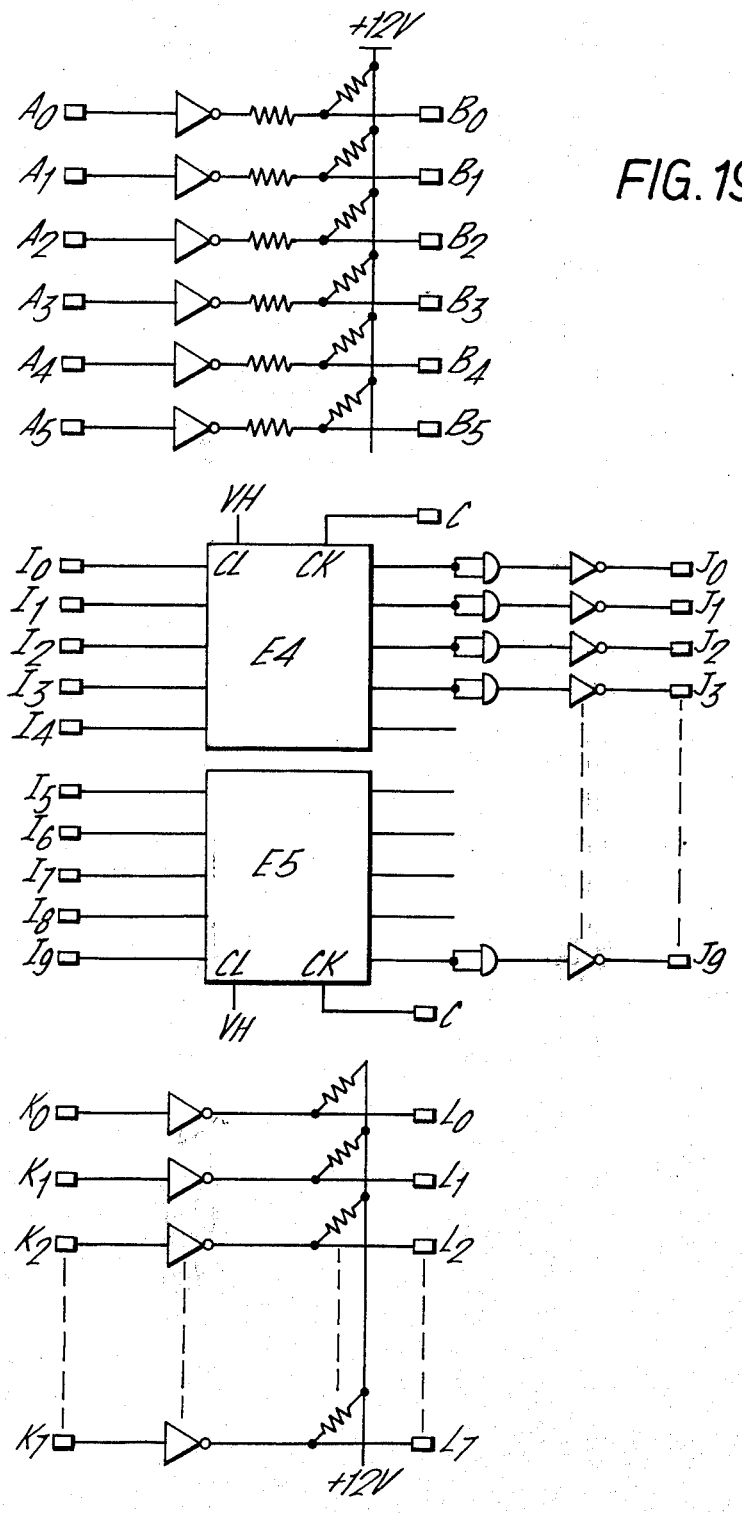
FIG. 19 is a circuit diagram of a driver and buffer circuit.

FIG. 19 is a circuit diagram of a driver and buffer circuit of which there are two, one of which is the item 29 and the other of which is the item 31. As will be apparent, the circuit of FIG. 19 provides a drive for the signals A0 to A5 and the signals K0 to K7 and buffering for the signals I0–9. Buffering is achieved by components E4, E5 of type 74,174. In the case of circuit board 31, components E4 and E5 are omitted.

Figure 20A:
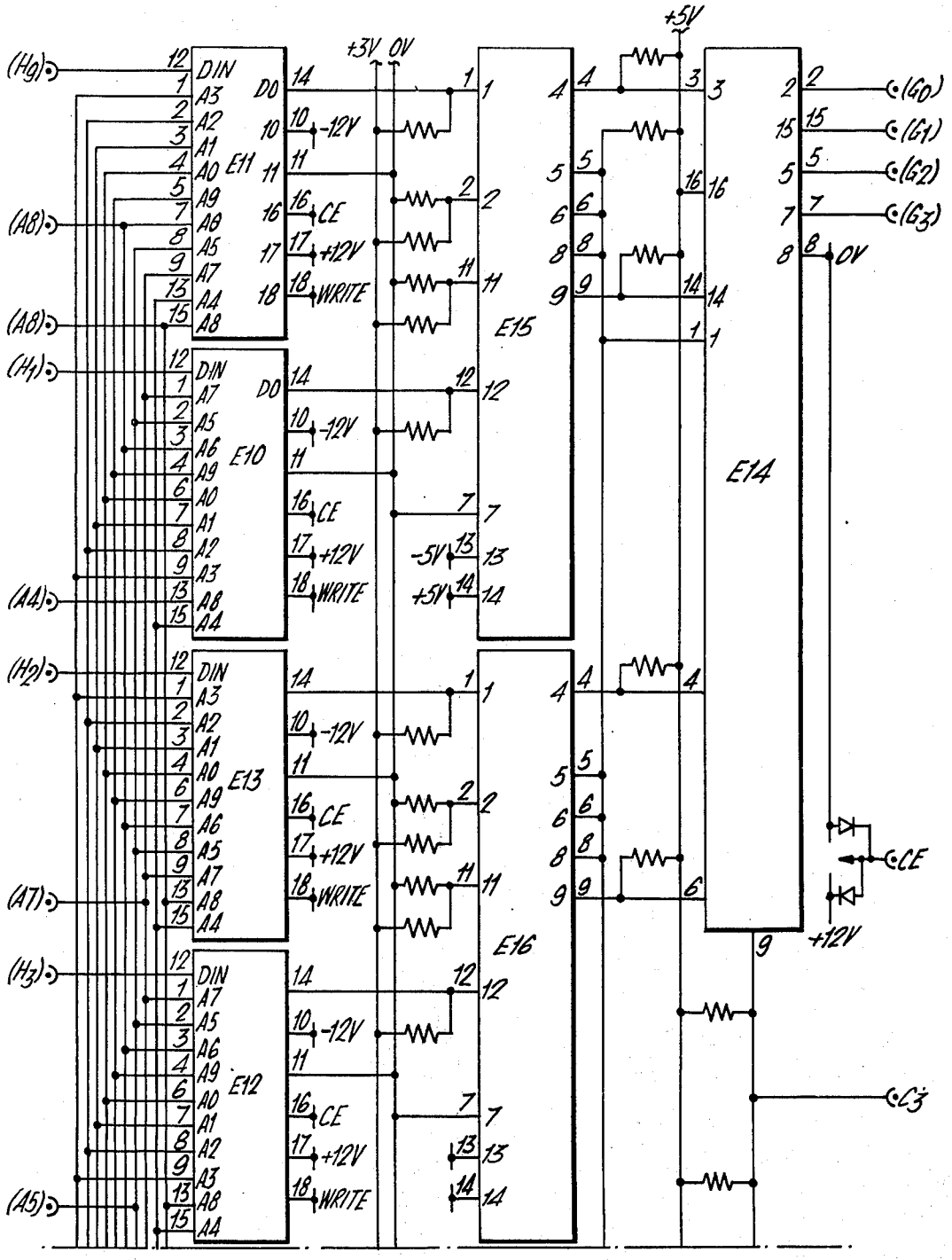
FIGS. 20A, 20B show a circuit diagram of an MOS memory.
Figure 20B:
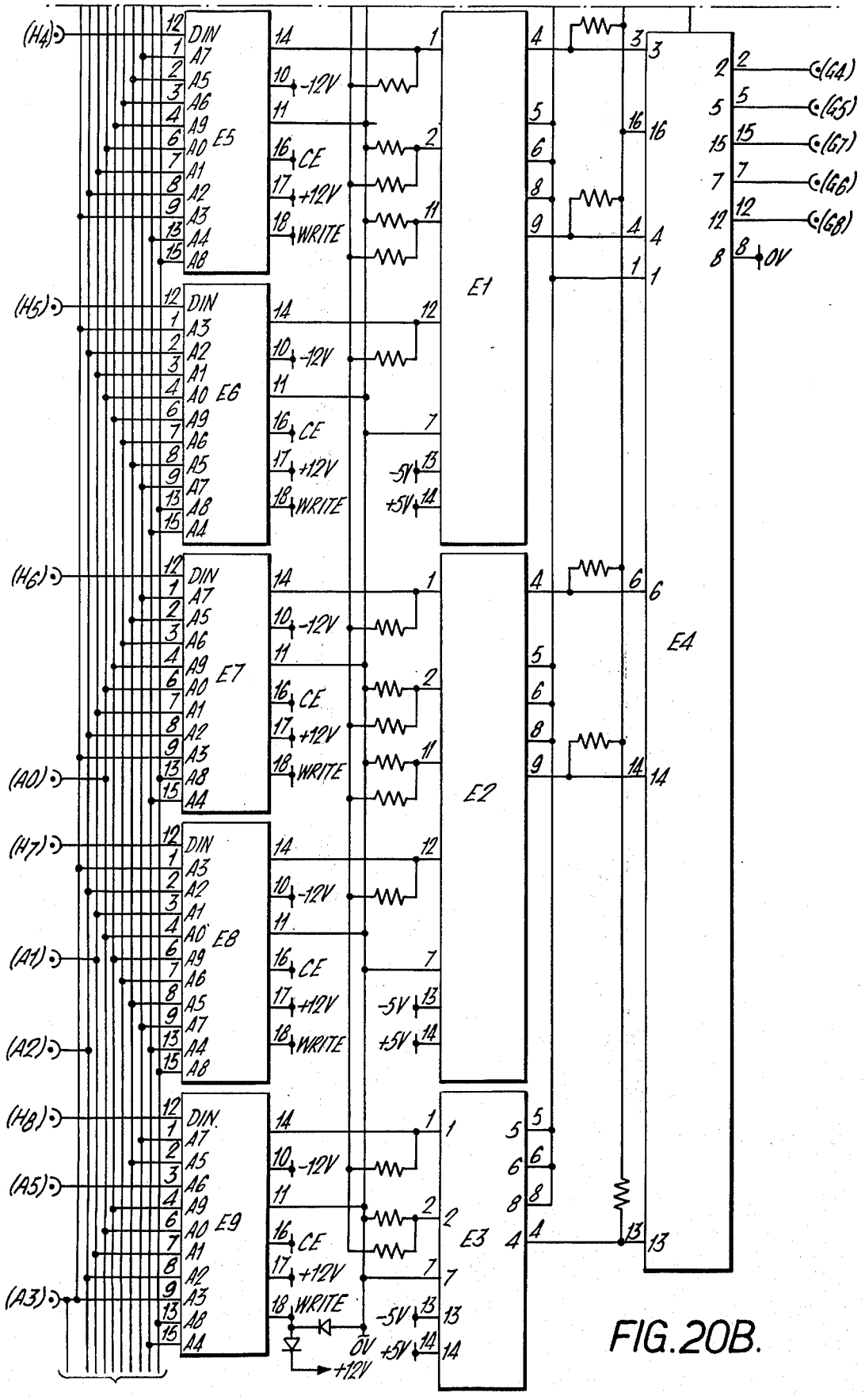

FIG. 20 is a circuit diagram of an MOS memory utilised as the waveforms function generator. Two further circuit boards according to FIG. 20 are used as the frequency function generators 28. As illustrated, the memory is a 1,024 work by 9 bit memory but is utilised in the frequency function generator as a 1,024 word by 8 bit memory. In the latter case components E3 and E9 can be omitted. The circuit board of FIG. 20 receives data at inputs HO to H8 and stores the information in components E5 to 13 (of type EA1,501 of the Company Electronic Arrays) addressed by way of address inputs A0 to A9. The data from the memory is supplied via components E1 to E3 and E15 and E16 (all of type 75,108A) and thence to buffers E14 and E4 of type 74,174. The outputs of the buffers are supplied to outputs G0 to G8.

Figure 21:
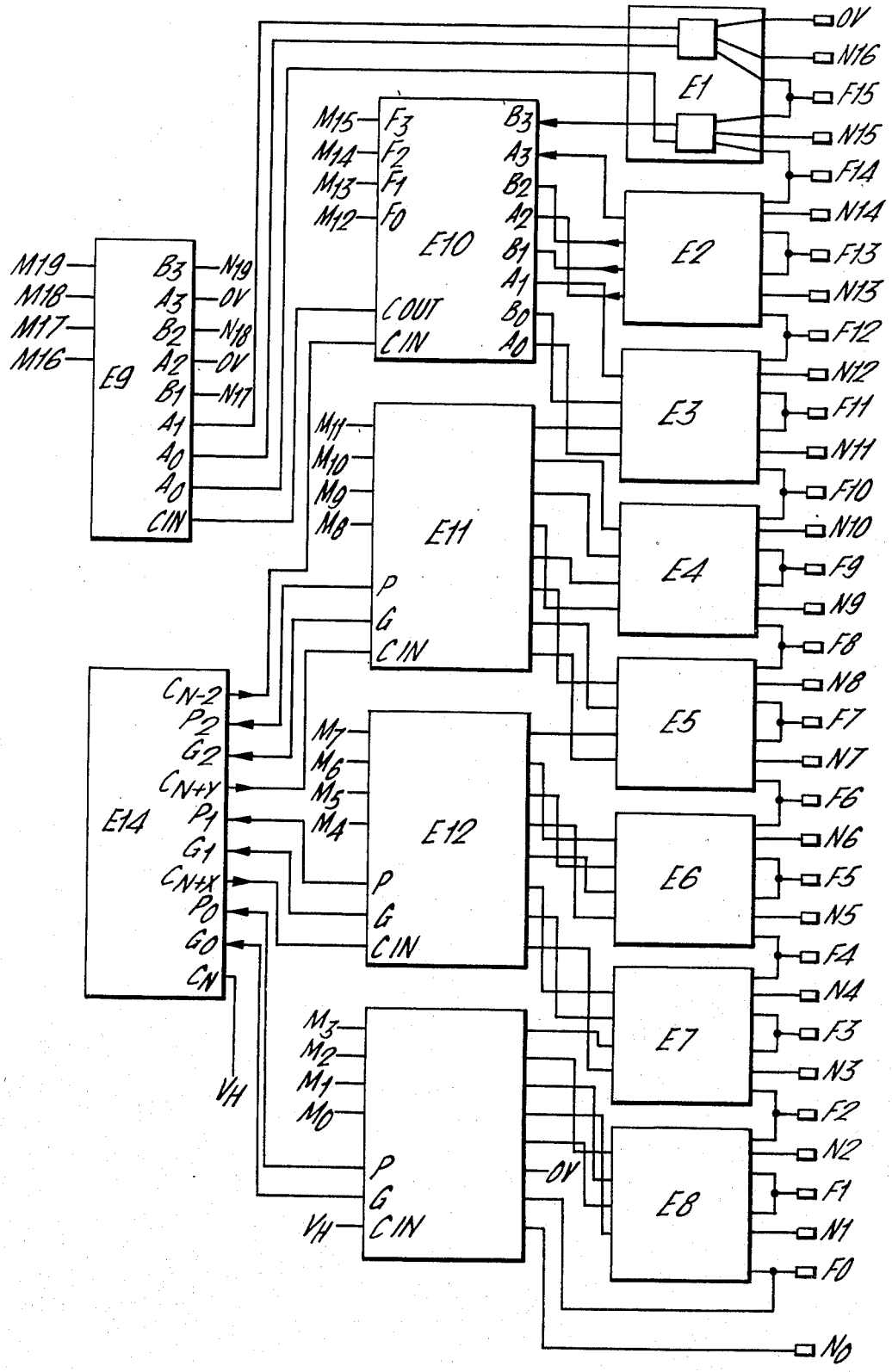
FIG. 21 is a circuit diagram of an oscillator adder.

FIG. 21 is a circuit diagram of an oscillator adder which is the component 27 for producing the addition $M=N+3F$. This circuit board comprises components E1 to E8 of type 74,183, components E9 to E13 of type 74,181, connected so as to carry out an addition of their A and B inputs, and a component E14 of type 74,182 for a look-ahead carry operation.

Figure 22A:
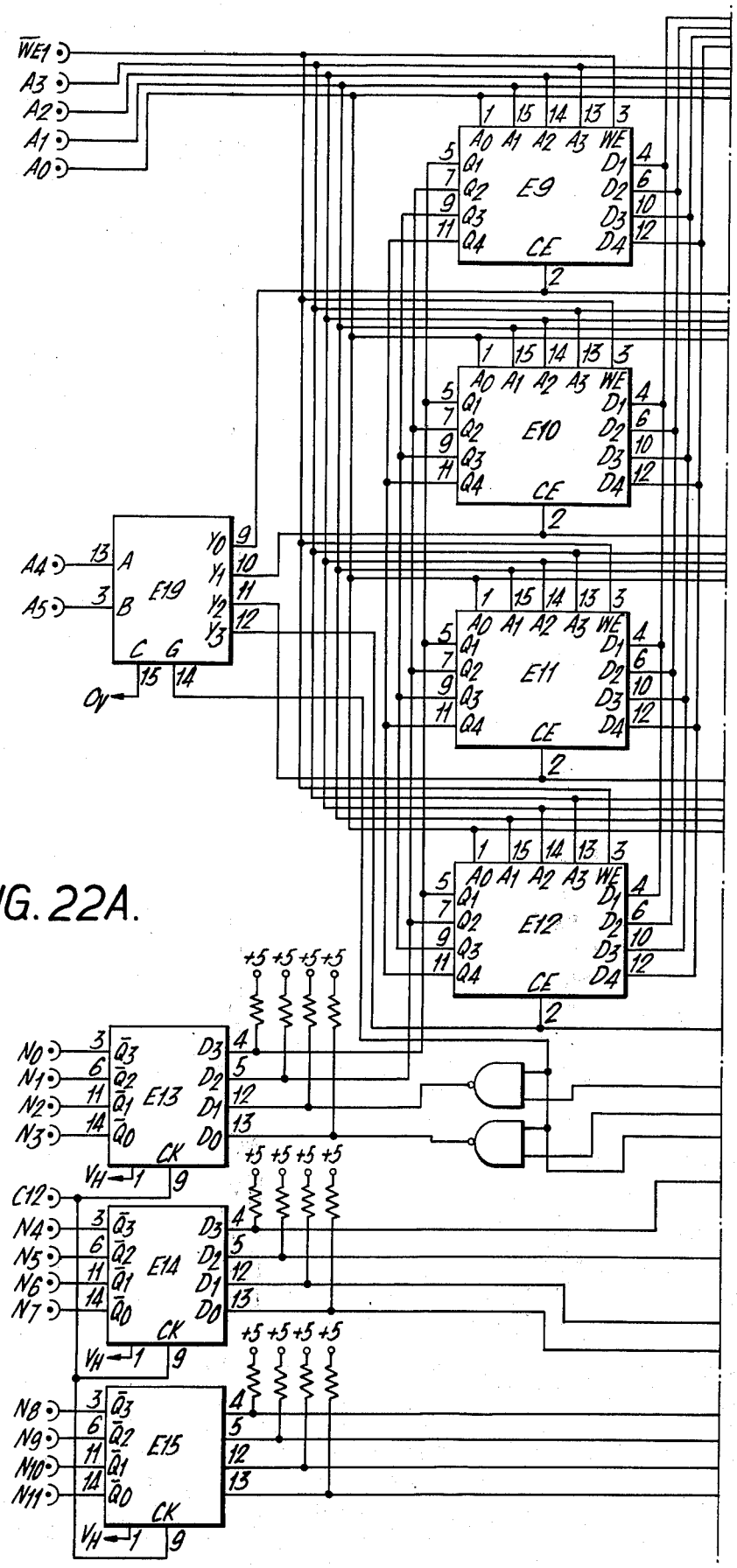
FIGS. 22A, 22B show a circuit diagram of oscillator stores.
Figure 22B:
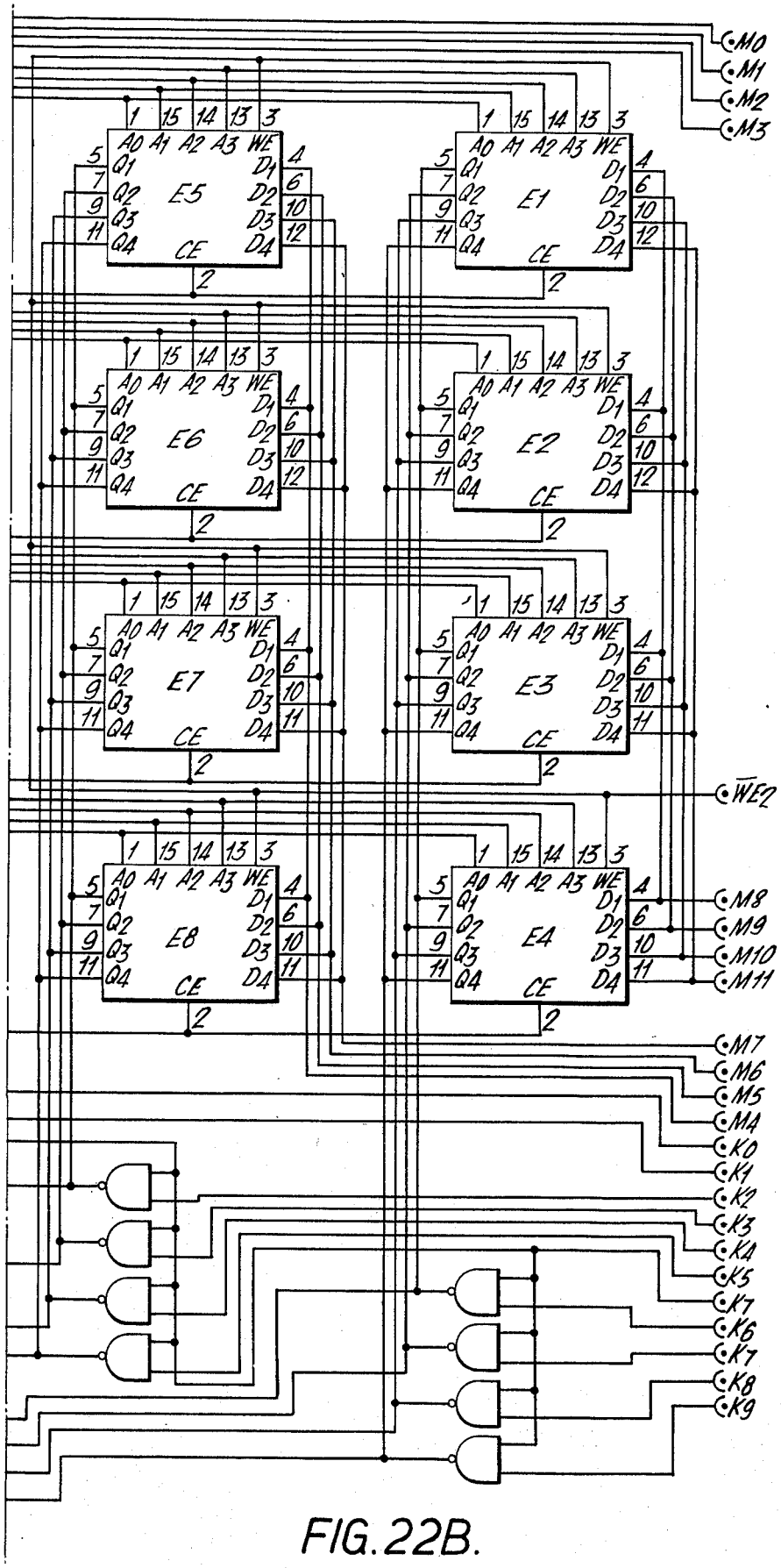

FIG. 22 is a circuit diagram of the circuit board 25 constituting the stores of the 64 oscillators of the synthesiser. It has inputs M0 to M11 connected to a storage array of components E1 to E12 of type 7,489. These components are addressed by signals at inputs A0 to A5, A4 and A5 being supplied by way of a component E19 of type 74,155. The circuit board also includes a driver circuit for the signals K0 to K9 utilising components E13 to E15 of type 74,175.

The array of storage components E1 to E12 is arranged in this circuit to act as a 64 word by 12 bit memory. Output from the memory is coupled via the components E13 to E15 to the outputs N0 to N11.

Figure 23A:
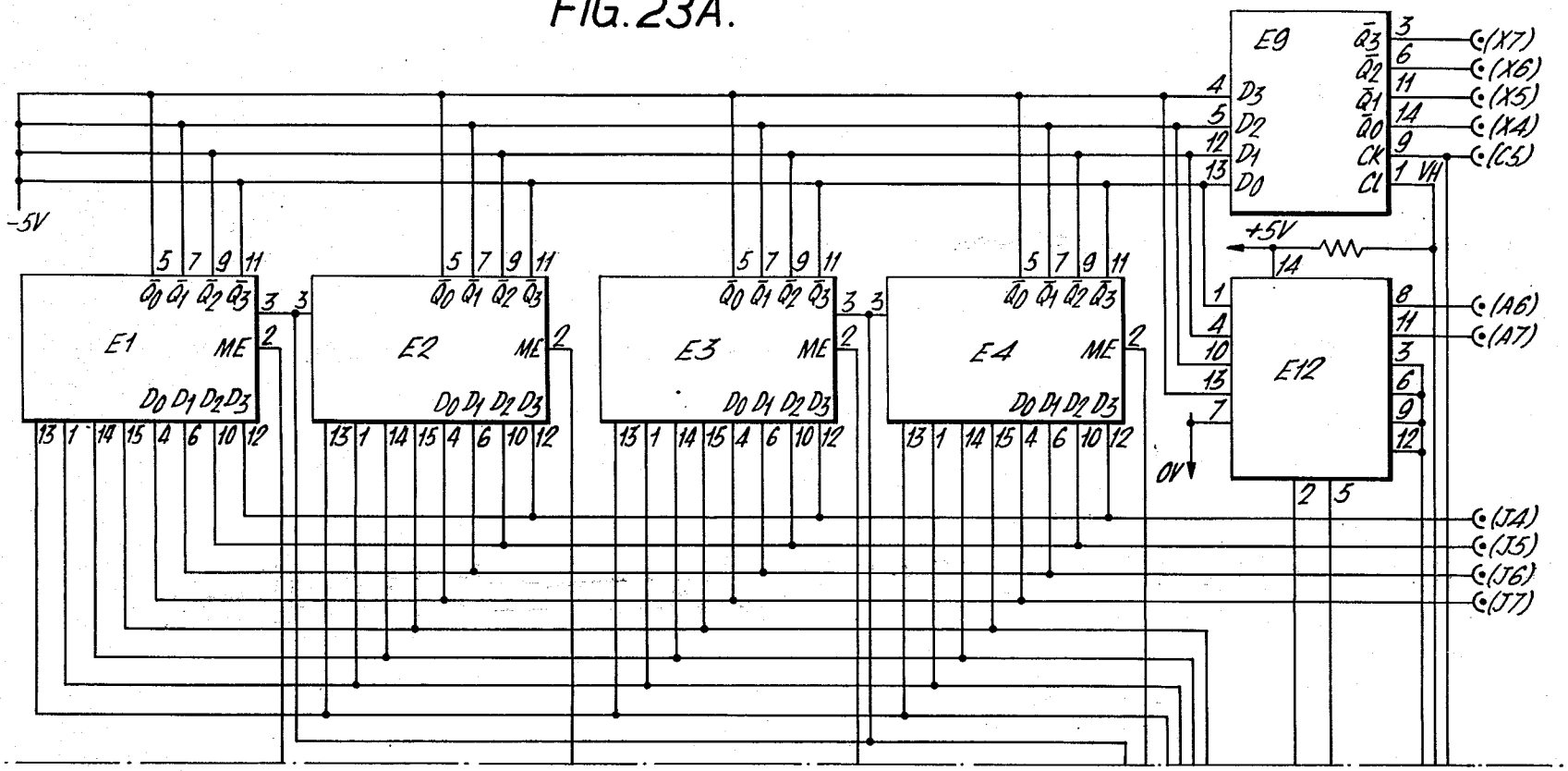
FIGS. 23A, 23B show a circuit diagram of an amplitude function generator.
Figure 23B:
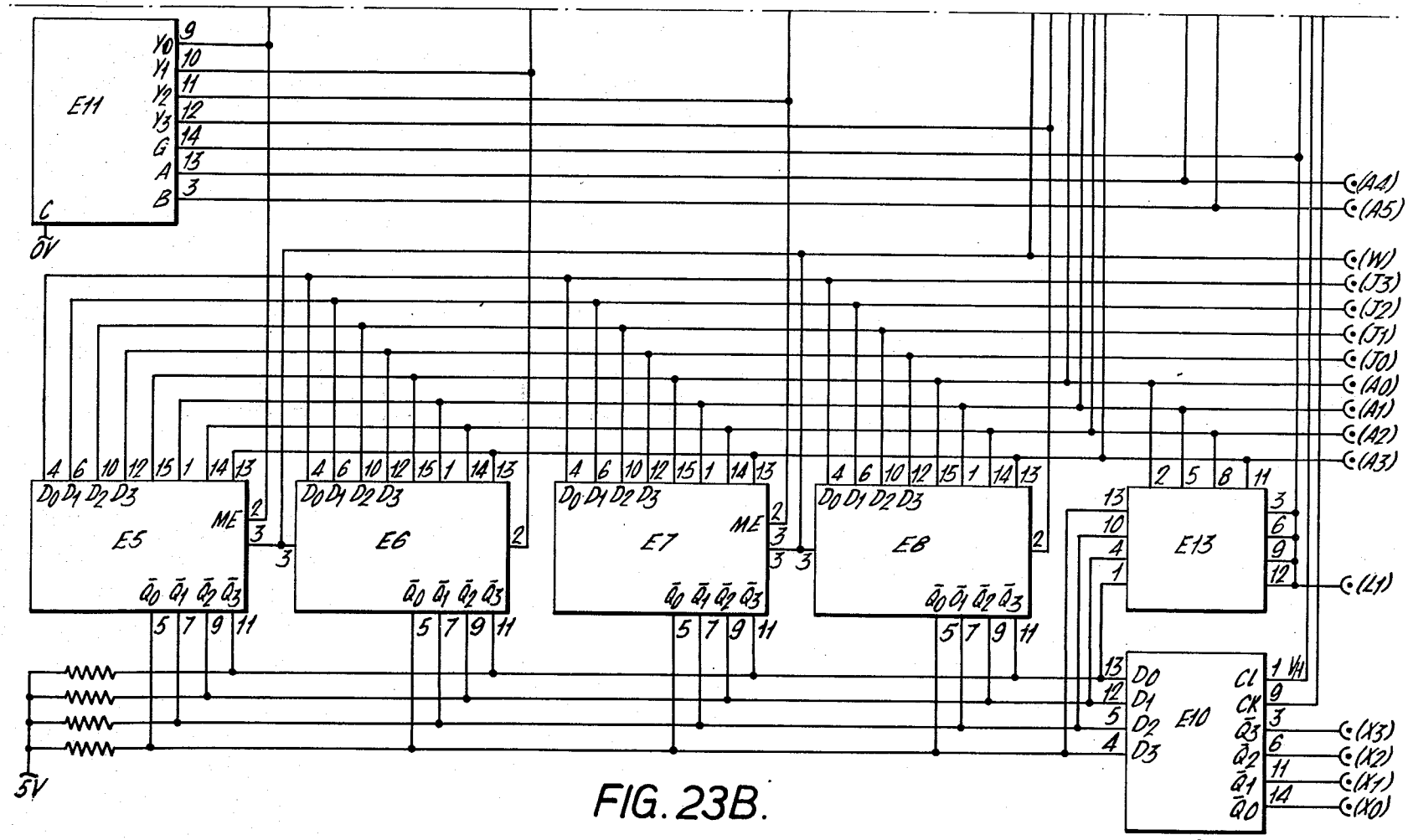

FIG. 23 is a circuit diagram of the amplitude function generator, which is a 64-word by 8-bit store constituted by storage components E1 to E8 of type 7,485. It has programming inputs J0–7, address inputs A0–7 and outputs X0–7. Address inputs A6 and A7 are supplied via a component E12 (type 7,401) and address inputs A4 and A5 are supplied via component E11 (type 74,155). Output is from registers E9 and E10 (of type 74,175).

Figure 24A:
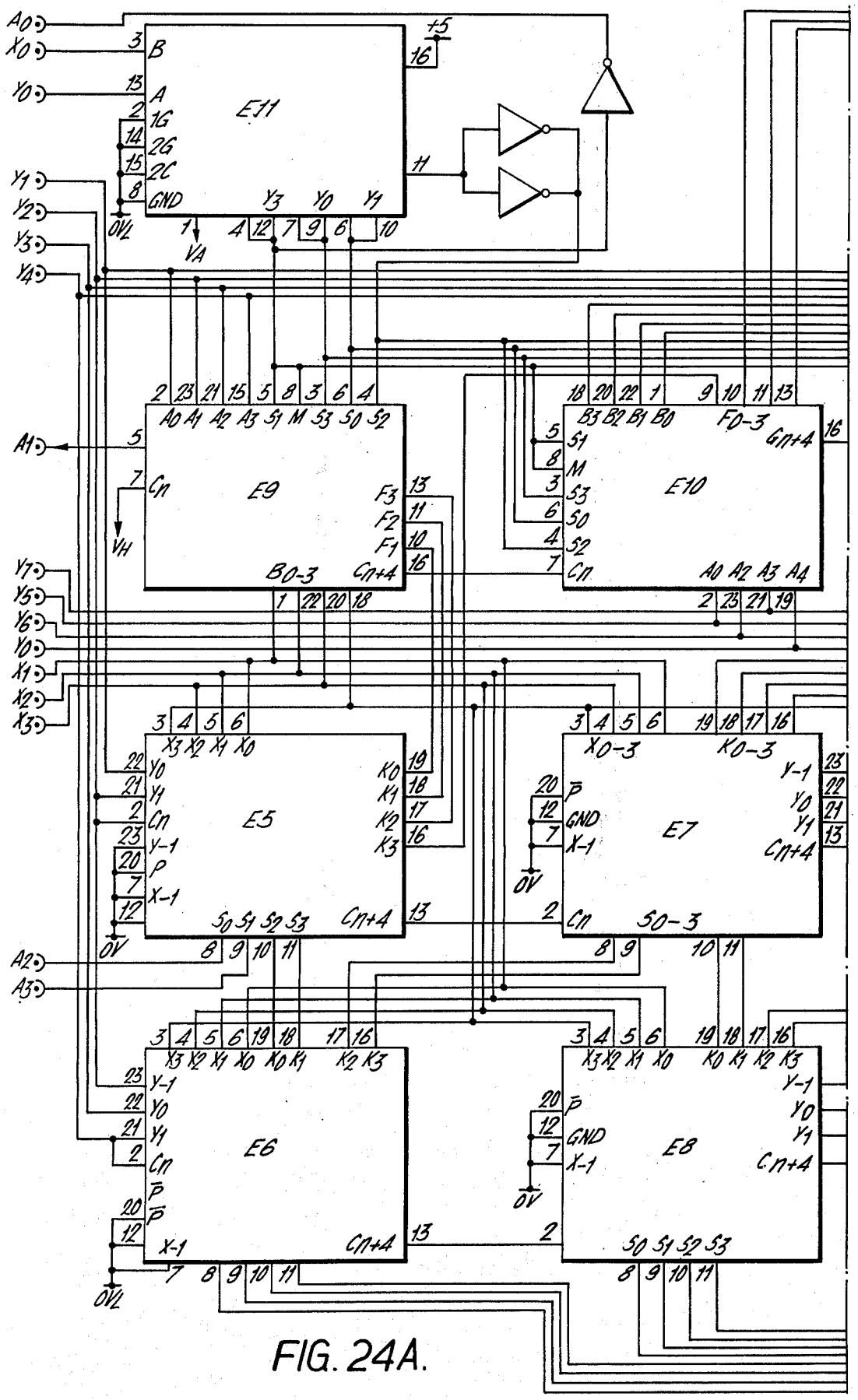
FIGS. 24A, 24B show a circuit diagram of a multiplier.
Figure 24B:
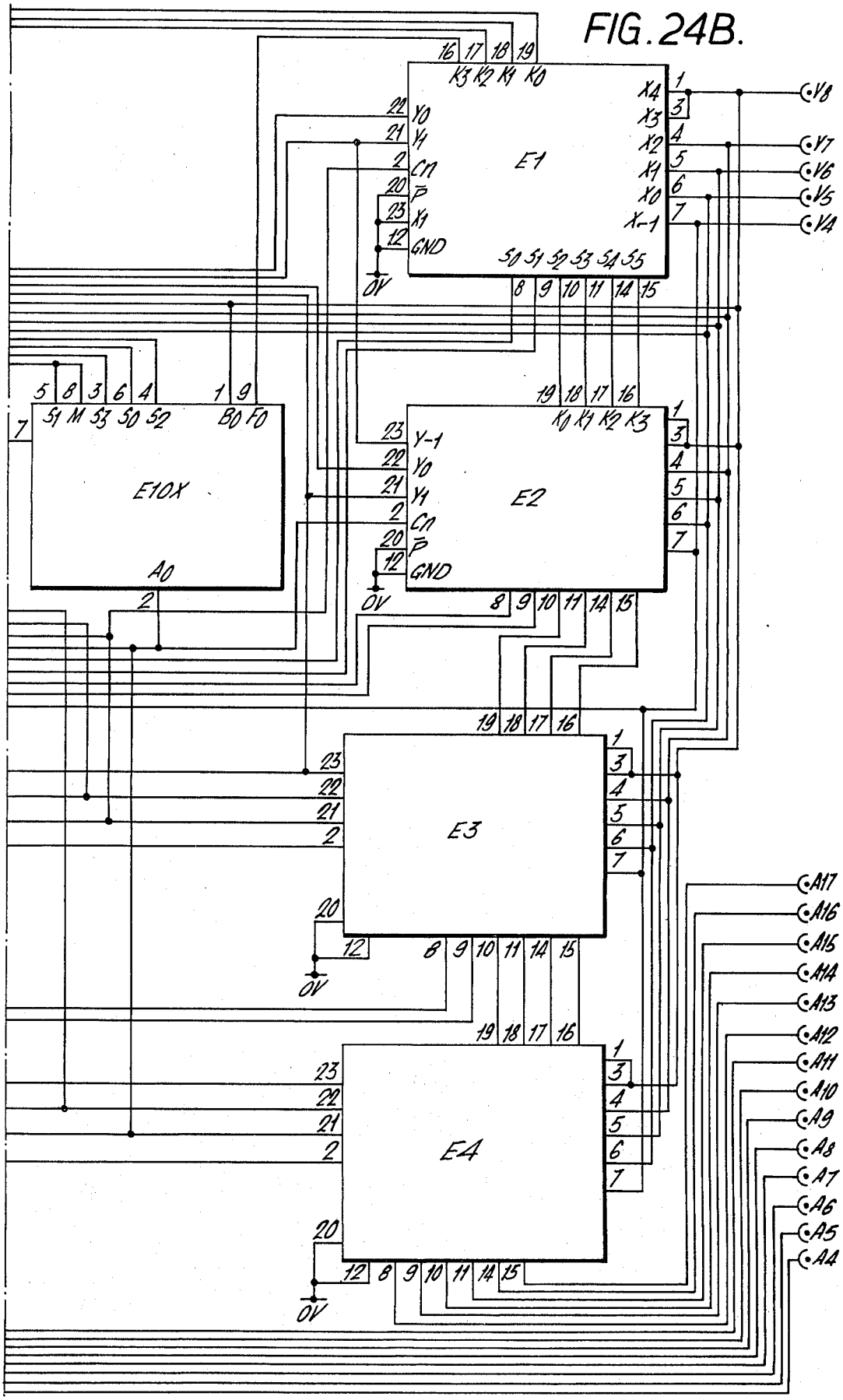

FIG. 24 is a circuit diagram of a multiplier constituting the circuit board 11 for multiplying the output waveform from the oscillators by the required amplitude data from the amplitude function generator 12. It comprises components E1 to E8 of type AM2505 (made by Advanced Micro Devices), components E9, E10 and E10X of type 74,181 and component G11 of type 74,155. These components are so arranged as to provide 9 bit by 9 bit multiplication of the two 9-bit words that this circuit board receives.

Figure 25A:
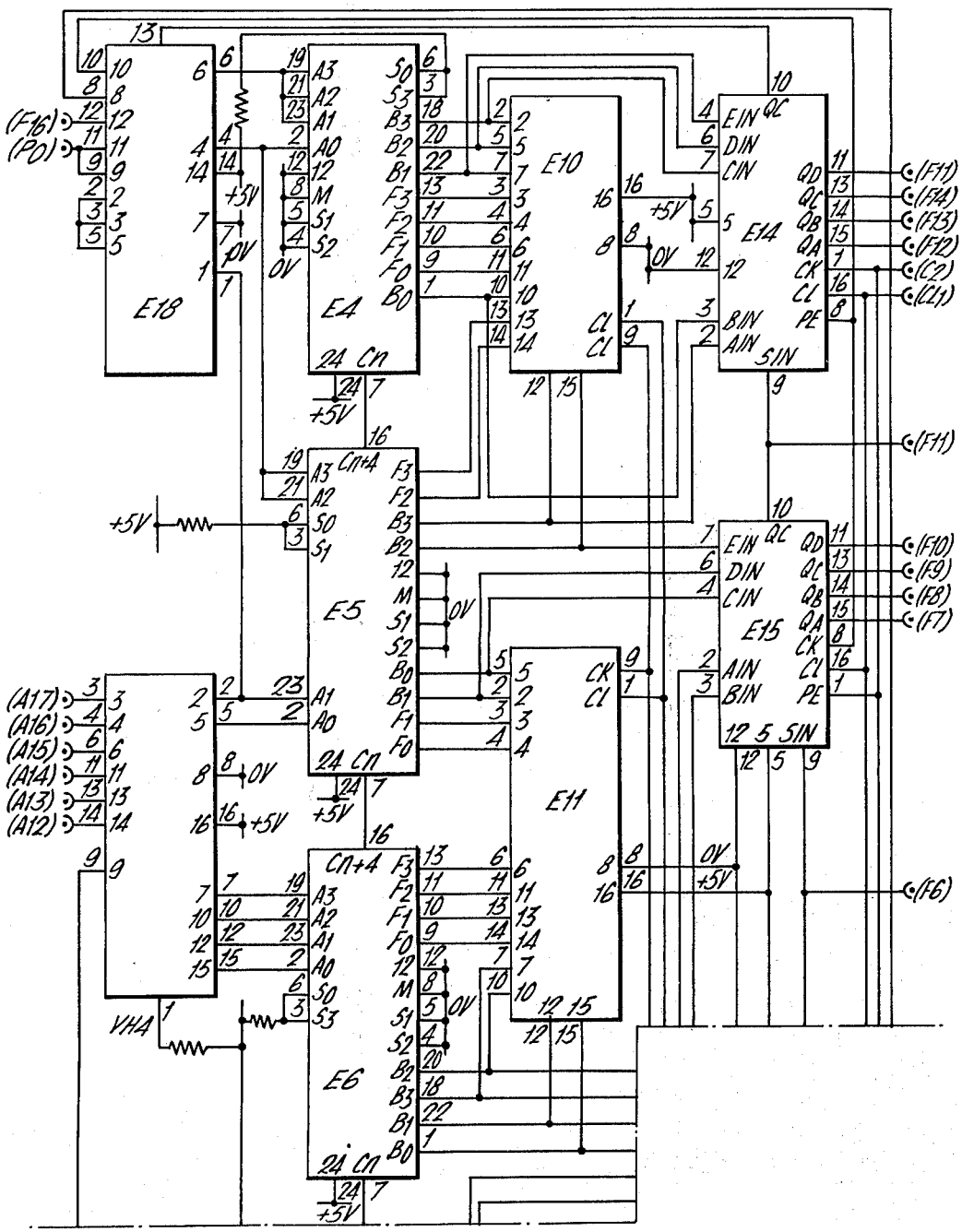
FIGS. 25A, 25B show a circuit diagram of an output accumulator.
Figure 25B:
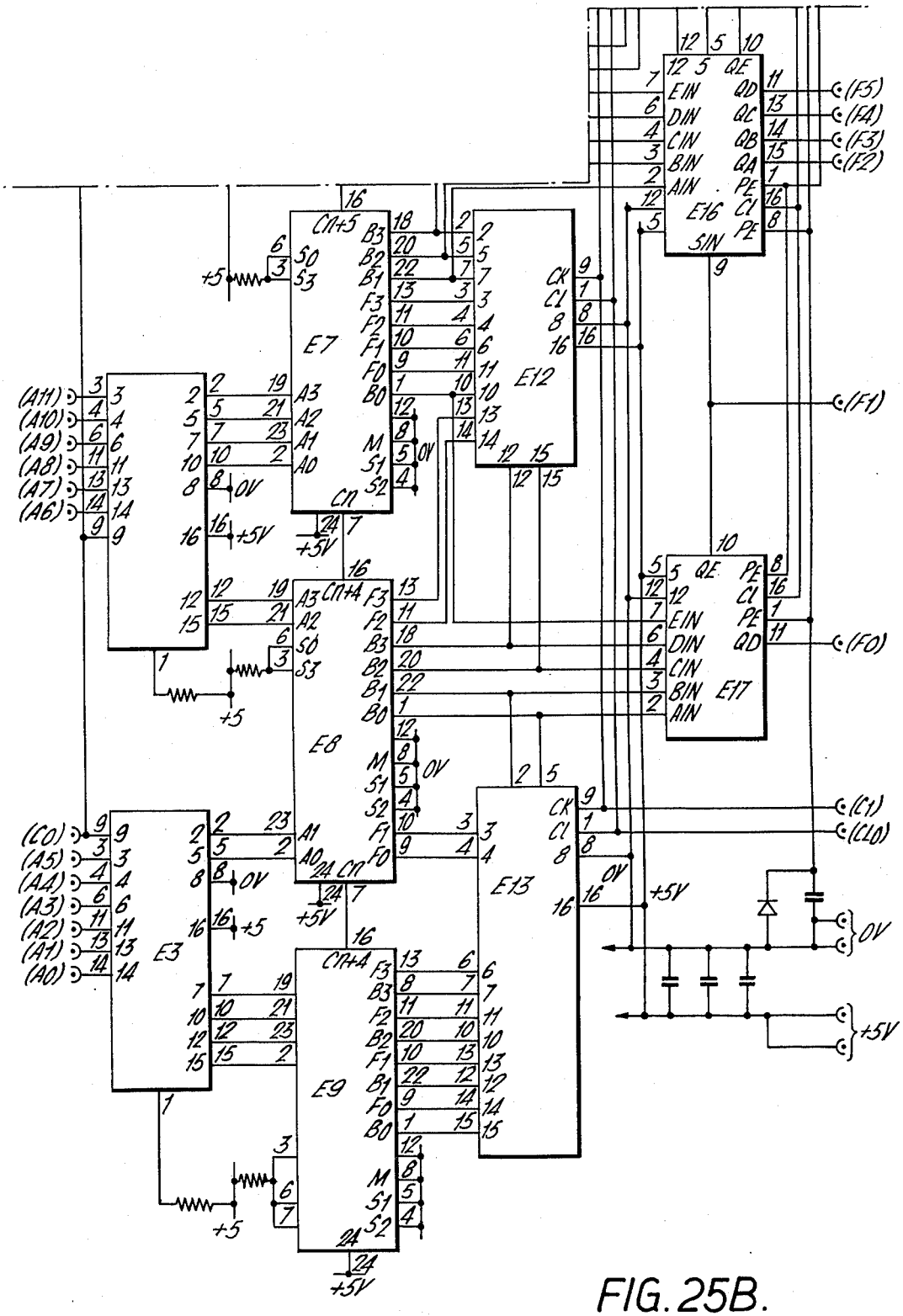

FIG. 25 shows a circuit diagram of an output accumulator constituting the circuit board 9 in which components E1 to E3 and E10 to E13 are of type 74,174, components E4 to E9 are of type 74,181, component E18 is of type 7,404 and components E14 to E17 are of type 7,496.

Figure 26:
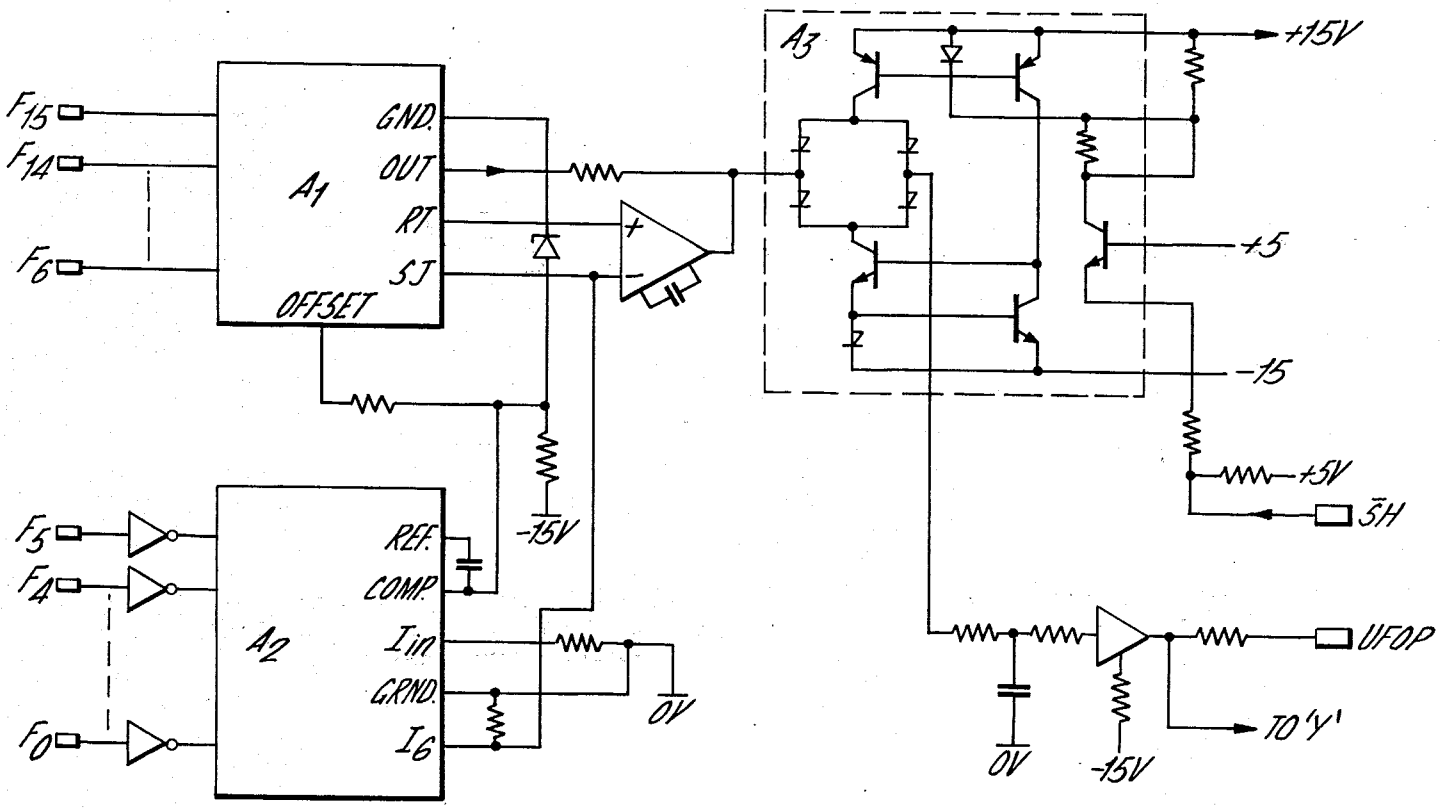
FIGS. 26 and 27 show the circuit diagram of a digital-to-analogue converter with a modulator.
Figure 27:
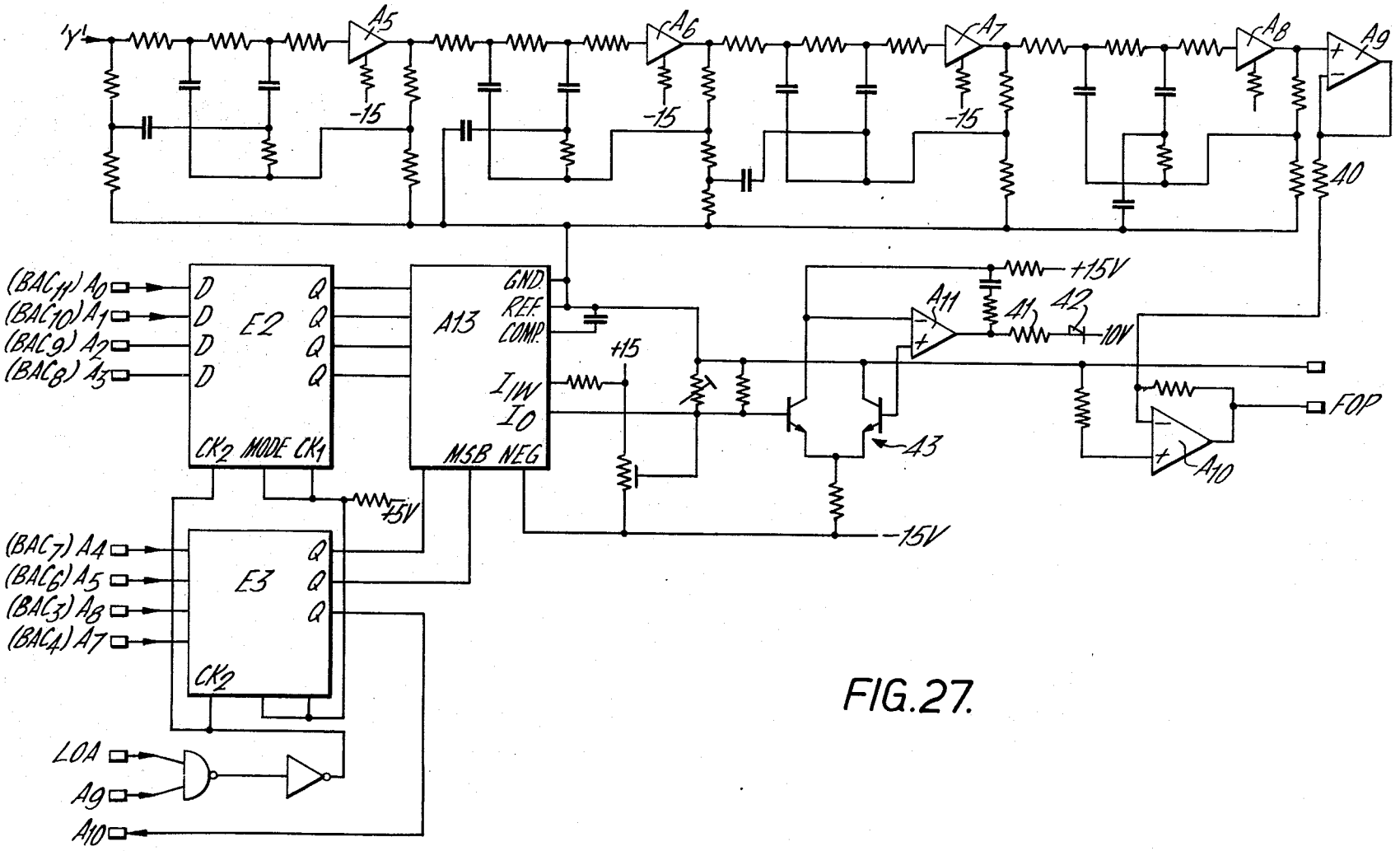

FIGS. 26 and 27 show the circuit of the circuit board 13 which is a digital-to-analogue converter including a filter and an exponential modulator.

FIG. 26 shows the inputs F0 to F15 feeding digital-to-analogue converter components A1 and A2, A1 being of type MDA10,225 (by Analogue Devices) and component A2 being of type ML14,062 (by Motorola). The outputs of the two components are combined by a differential amplifier and the result is supplied to an analogue switch component A3 of type ZN400E (by Ferranti). The switch A3 is switched so as to sample the output of the digital-to-analogue converters only when their combined output is stationary; its output is supplied via an amplifier to output UFOP, this being an unfiltered output of the circuit board. The signal from the switch A3 is also supplied to the circuit of FIG. 27 at Y, where it is fed through a filtering network including amplifiers A5 to A9. The output of amplifier A9 is supplied to a differential amplifier A10 the output of which is connected to the output FOP of the circuit board.

This output is modulated exponentially by the use of light-sensitive resistors 40 and 41 and a luminescent diode 42. The diode 42 acts on the resistor 40 to modulate the FOP output. Resistor 41 provides feedback across an amplifier A11 which receives a control signal which has a value which is the exponential of the value of a signal fed to a long-tail pair 43. This latter signal is obtained from a digital-to-analogue converter component A13 of type ML14,062 (by Motorola) fed by components E2 and E3 (of type 7,495) supplied with data A0–7 from the BAC data lines. The components E2 and E3 are controlled by input signals LOA (giving an instruction to load) and a signal BAC0, 1 or 2, depending upon the voice concerned. It is also to be noted that the component E3 supplies an output signal A10 determining the dynamic range. As will be seen from FIG. 17, the signal A10 produces a control signal GUV3 (A, B or C). Signal GUV3 controls the accumulator 9 shown in FIG. 25, where it is applied to a control input C2 to cause the output components E14 to 16 of FIG. 25 to operate to shift their data content by three bits, thereby to give the effect of amplifying their data content.

I claim:

1. A waveform analysis and synthesis system comprising an analyser operable to produce from a complex waveform a plurality of digital signals representing the component of the complex waveform in respective frequency bands, a synthesiser comprising a corresponding plurality of digital waveform producing means each operable to produce from the digital information relating to an associated frequency band digital information defining successive points of a corresponding waveform at a specific frequency, said waveform producing means comprising respective storage zones for holding as digital words the momentary values of the waveforms and updating means common to the storage zones for updating the words in the storage zones in succession, the updating means comprising digital adding means for adding the momentarily existing words of the storage zones to factors determining the frequencies of the waveforms, the contents of the storage zones defining momentary values of unit waveforms and the zones being connected to amplitude modulating means for giving the waveforms values defined by control signals suppled to the modulating means, a store for present waveform amplitude values and a digital, amplitude interpolator for receiving digital data defining new amplitude values and digital data defining an amplitude change time, the interpolator being operable to change the stored present value in a plurality of increments to the required new value in said amplitude change time.

2. A system as claimed in claim 1, and comprising storage means for storing adjustable digital words constituting said factors.

3. A system as claimed in claim 2 comprising a digital interpolator for receiving data defining new frequency values and data defining a frequency change time, the interpolator being operable to update the storage means by causing a word therein to change in a plurality of increments from its existing value to a value determined by the new frequency value and in said time.

4. A waveform synthesiser comprising a plurality of digital waveform producing means each operable to produce a sequence of digital representing a waveform at a distinct frequency, storage means of sets of digital signals for determining successive values of the respective waveforms of the waveform producing means, said signals defining the energy content of a complex waveform in respective frequency bands, means for controlling the amplitudes of the waveforms of the waveform producing means in dependence upon the digital signals of the storage means and an interpolator coupled between the storage means and the controlling means for interpolating a plurality of amplitude values between successive amplitude values from the storage means.

5. A waveform synthesizer comprising digital waveform producing means including a plurality of storage zones and operable to produce in the zones respective series of digitally coded words representing in each series values of successive points of a waveform at a specific frequency within the audible range, the frequencies of the waveforms being distributed substantially throughout the audible range, means operable to combine the series from the zones to produce a series of words representing values of successive points of a composite waveform, control means for controlling a parameter of the waveforms represented by at least some of said series of words, the waveform producing means comprising common updating means for updating the words in the zones in succession, storage means for storing digital words defining the respective frequencies of the waveforms the common updating means being digital word combining means for sequentially combining the momentary words of the storage zones with the the respective words defining the respective frequencies to provide respective new momentary words for the storage zones, the storage means being a read-write memory having writing means enabling the words in the memory to be updated, and a digital interpolator for receiving a digital word defining a new frequency value for one of the waveforms and a frequency change time, the interpolator being operable to update the storage means by way of said writing means by causing the appropriate word in said storage means to change in a plurality of increments to the new word in the defined frequency change time.

6. A synthesiser as claimed in claim 5, wherein the words succeeding one another in each zone define a sawtooth waveform said synthesiser further comprising a waveform function store for storing in digital form the amplitudes of successive points of a required waveform shape, the store having an addressing input connected to receive the words from successive ones of the storage zones to produce words defining the corresponding values of the waveforms with the shape of the required waveform in time-sharing fashion.

7. A synthesiser as claimed in claim 6, wherein the store provides unit waveforms and is connected to digital amplitude modulating means for giving the waveforms values defined by control signals supplied to the modulating means.

8. A synthesiser as claimed in claim 7, comprising a digital, present value store for storing the present amplitude values of the modulating means, and a digital, amplitude interpolator for receiving digital words defining new amplitude values for the waveforms and associated amplitude change times, the amplitude interpolator being operable to change the present values in a plurality of increments to the defined new values in the respective amplitude change times.

9. A synthesiser as claimed in claim 7 comprising a read-write memory for storing adjustable digital words defining respective frequencies for the waveforms, the waveform producing means comprising common updating means for the storage zones, the common updating means being adding means for sequentially adding the momentary existing words of the storage zones to the respective words of the memory to provide respective new momentary words for the storage zones.

10. A synthesiser as claimed in claim 9, wherein the waveform function store, the interpolator, the present value store, the modulating means and the combining means are provided at least in duplicate so that each waveform can be produced simultaneously in two forms with different waveform shapes and with different amplitude control.

11. A waveform synthesiser comprising digital waveform producing means including a plurality of storage zones and operable to produce in the zones respective series of digitally coded words representing in each series values of successive points of a waveform at a specific frequency within the audible range, the frequencies of the waveforms being distributed substantially throughout the audible range, means operable to combine the series from the zones to produce a series of words representing values of successive points of a composite waveform, control means for controlling a parameter of the waveforms represented by at least some of said series of words, the words succeeding one another in each zone defining a sawtooth waveform, said synthesiser further comprising a waveform function store for storing in digital form the amplitudes of successive points of a required waveform shape, the store having an addressing input connected to receive the words from successive ones of the storage zones to produce words defining the corresponding values of the waveforms with the shape of the required waveform in time-sharing fashion, the store providing unit waveforms and being connected to digital amplitude modulating means for giving the waveform values defined by control signals supplied to the modulating means, a digital, present value store for storing the present amplitude values of the modulating means, and a digital, amplitude interpolator for receiving digital words defining new amplitude values for the waveforms and associated amplitude change times, the amplitude interpolator being operable to change the present values in a plurality of increments to the defined new values in the respective amplitude change times.

12. A synthesiser as claimed in claim 11, comprising a read-write memory for storing adjustable digital words defining respective frequencies for the waveforms, the waveform producing means comprising common updating means for the storage zones, the common updating means being adding means for sequentially adding the momentary existing words of the storage zones to the the respective words of the memory to provide respective new momentary words for the storage zones.

13. A synthesiser as claimed in claim 12, wherein the waveform function store, the interpolator, the present values store, the modulating means and the combining means are provided at least in duplicate so that each waveform can be produced simultaneously in two forms with different waveform shapes and with different amplitude control.

* * * * *